US006219503B1

(12) United States Patent
Miyake et al.

(10) Patent No.: US 6,219,503 B1
(45) Date of Patent: Apr. 17, 2001

(54) SHEET PROCESSING APPARATUS AND METHOD WITH MULTI-MODE SHEET CONVEYING

(75) Inventors: Norifumi Miyake, Kashiwa; Chikara Sato, Hachiohji; Yasuo Fukazu; Mitsushige Murata, both of Abiko; Masatoshi Yaginuma, Toride; Kiyoshi Okamoto, Toride; Tsuyoshi Moriyama, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/438,525

(22) Filed: Nov. 12, 1999

(30) Foreign Application Priority Data

Nov. 17, 1998 (JP) ..... 10-327324

(51) Int. Cl.[7] ..... G03G 15/00
(52) U.S. Cl. ..... 399/85; 399/407
(58) Field of Search ..... 399/45, 82, 85, 399/407, 403, 404, 408; 270/58.04, 58.05; 271/288

(56) References Cited

U.S. PATENT DOCUMENTS

| | | | | |
|---|---|---|---|---|
| 4,329,046 | * | 5/1982 | Burkett et al. | 355/77 |
| 4,626,156 | * | 12/1986 | Baughman et al. | 412/33 |
| 4,693,590 | * | 9/1987 | Umeda . | |
| 5,042,793 | | 8/1991 | Miyake | 271/293 |
| 5,136,341 | * | 8/1992 | Takemura et al. . | |
| 5,299,795 | | 4/1994 | Miyake | 271/9 |
| 5,321,466 | * | 6/1994 | Kimura et al. . | |
| 5,390,016 | | 2/1995 | Hoshi et al. . | |
| 5,455,667 | | 10/1995 | Hiroi et al. . | |
| 5,580,039 | | 12/1996 | Takehara et al. | 270/58.11 |
| 5,653,573 | * | 8/1997 | Aoki et al. | 414/790.2 |
| 5,761,600 | | 6/1998 | Murata | 399/403 |
| 5,839,019 | * | 11/1998 | Ito | 399/45 |
| 6,021,305 | | 2/2000 | Sato et al. | 399/374 |

* cited by examiner

*Primary Examiner*—Robert Beatty
(74) *Attorney, Agent, or Firm*—Fitzpatrick, Cella, Harper & Scinto

(57) ABSTRACT

A sheet processing apparatus, such as a finisher, to be used in an image forming device, has a sheet conveying device for allowing conveyance and temporary stopping conveyance to place the sheet in a waiting state, a sheet-conveying-condition detector for detecting a conveying condition for each sheet, a first mode of conveying a sheet by driving the sheet conveying device without placing the sheet conveying device in a waiting state, a second mode of conveyance which places the sheet conveying device in the waiting state, thereafter releasing the waiting state of the sheet conveying device in accordance with conveyance of a succeeding sheet, and conveying preceding and succeeding sheets in a superposed state, and a third mode of conveyance, placing the sheet conveying device in the waiting state, thereafter releasing the waiting state of the sheet conveying device, and conveying the preceding sheet separately from the succeeding sheet. A controller switches the sheet conveying device to the third mode when the sheet-conveying-condition detector has detected that a sheet having a different condition is included within a plurality of sheets to be discharged from the sheet conveying device in a superposed state in the second mode.

48 Claims, 16 Drawing Sheets

ORIGINAL D
109

(0,0)
REAL IMAGE 111
110

ORIGINAL D
109

(0,0)
READ IMAGE (0,0)
AFTER MIRROR-IMAGE PROCESSING 111
110

SHEET PROCESSING APPARATUS AND METHOD WITH MULTI-MODE SHEET CONVEYING

BACKGROUND OF THE INVENTION

1. Field of the Invention

The present invention relates to a sheet processing apparatus, and more particularly, to a sheet processing apparatus which is used in an image forming apparatus, such as a copier, a laser-beam printer or the like, and which performs processing, such as sorting, binding and the like, for sheets discharged from the image forming apparatus.

2. Description of the Related Art

In some apparatuses for conveying, mounting and sorting sheets discharged from an image forming apparatus or the like, in order to prevent degradation in the processing capability due to sheet processing at the downstream side requiring a relatively long processing time, such as a bundle-binding operation, a portion where a sheet is temporarily stopped is provided at a conveying portion, in order to temporarily interrupt conveyance of the sheet. Thereafter, a plurality of sheets are conveyed together with another sheet conveyed from the upstream side, in order to secure a time for sheet processing at the downstream side and prevent a decrease in the overall efficiency of sheet processing. In some of such apparatuses, when the system enters a non-operating state due to a sheet jam or the like, in order to prevent occurrence of curl of a sheet to a degree more than necessary and prevent the sheet from remaining within the apparatus from the viewpoint of maintenance of the system, the sheet is automatically discharged when the sheet is present at a temporarily stopped portion.

However, an apparatus in which a sheet is automatically discharged when the system is operating and the sheet is present at a temporarily stopped retracted portion is not present.

In the above-described situation, problems may arise, such as a failure in sheet conveyance or sheet alignment due to simultaneous conveyance of sheets having different conveying speeds in a superposed state.

Furthermore, when there is a sheet which is temporarily stopped in order to perform the above-described processing, there is a problem such that another sheet cannot be conveyed to the conveying path for the stopped sheet or to another portion requiring driving for a portion for conveying the stopped sheet.

SUMMARY OF THE INVENTION

It is an object of the present invention to provide a sheet processing apparatus and an image forming apparatus including the same, and more particularly, to provide a sheet processing apparatus in which, when sheets having different conveying conditions are included in sheet conveying means, an excellent sheet conveying property, and an excellent sheet aligning property after sheet discharge are realized by preventing simultaneous conveyance of a plurality of sheets from the sheet conveying means.

In accordance with these objects, there is provided a sheet processing apparatus comprising sheet conveying means for conveying a sheet and placing a sheet in a waiting state by temporarily stopping conveyance of the sheet, the sheet conveying means operable in one of at least a first mode, a second mode and a third mode, and sheet-conveying-condition detection means for detecting a conveying condition for each sheet. In the first mode, a sheet is conveyed by driving the sheet conveying means without placing the sheet in a waiting state. In the second mode, a sheet is conveyed by driving the sheet conveying means and putting the sheet conveying means in the waiting state, thereafter releasing the waiting state of the sheet conveying means in accordance with conveyance of a succeeding sheet, and conveying preceding and succeeding sheets in a superposed state. In the third mode, a sheet is conveyed by driving the sheet conveying means and putting the sheet conveying means in the waiting state, thereafter releasing the waiting state of the sheet conveying means and conveying the preceding sheet separately from the succeeding sheet. Control means switch the sheet conveying means from the second mode to the third mode when the sheet-conveying-condition detection means has detected that a sheet having a different sheet conveying condition is included within a plurality of sheets to be discharged from the sheet conveying means in a superposed state when in the second mode.

According to another aspect of the present invention, an image forming apparatus includes the above-described sheet processing apparatus, a main body having therein image forming means for forming an image on a sheet, and discharging means of a main body for discharging the sheet having the image formed thereon by the image forming means to the sheet processing apparatus.

According to still another aspect of the present invention, a method for controlling an image forming apparatus in which a preceding sheet is temporarily stopped in a waiting state in a sheet conveying path and is then conveyed together with a succeeding sheet upon arrival of the succeeding sheet includes the steps of detecting whether or not a sheet conveying condition for the succeeding sheet is the same as a sheet conveying condition for the preceding sheet, and restarting conveyance of the preceding sheet in a waiting state separately from the succeeding sheet when a result of the detection is negative.

According to yet another aspect of the present invention, an image forming apparatus has image forming means for forming an image on a sheet, sheet conveying means for conveying a sheet and placing the sheet in a waiting state by temporarily stopping conveyance of the sheet having the image formed thereon, the sheet conveying means operable in one of at least first mode, a second mode and a third mode, and sheet-conveying-condition detection means for detecting a conveying condition for each sheet. In the first mode, a sheet is conveyed by driving the sheet conveying means without placing the sheet in a waiting state. In the second mode, a sheet is conveyed by driving the sheet conveying means without placing the sheet in a waiting state. In the second mode, a sheet is conveyed by driving the sheet driving means and putting the sheet conveying means in the waiting state, thereafter releasing the waiting state of the sheet conveying means in accordance with conveyance of a succeeding sheet, and conveying preceding and succeeding sheets in a superposed state. In the third mode, a sheet is conveyed by driving the sheet conveying means and putting the sheet conveying means in the waiting state, thereafter releasing the waiting state of the sheet conveying means, and conveying the preceding sheet separately from the succeeding sheet. Control means switch the sheet conveying means from the second mode to the third mode when the sheet-conveying-condition detection means has detected that a sheet having a different sheet conveying condition is included within a plurality of sheets to be discharged from the sheet conveying means in a superposed state in the second mode.

According to the above-described configuration, when simultaneously conveying a plurality of sheets using a sheet temporarily awaited by the sheet conveying means, if a different condition with respect to a "sheet conveying condition" serving as one of conditions relating to the sheet conveyance, such as the speed of a sheet, and the like, an operation of conveying one or a plurality of sheets in a waiting state is resumed, and simultaneous conveyance of a plurality of sheets having different conveying conditions is prohibited, so that an excellent sheet conveying property and an excellent sheet aligning property are realized.

When there is a sheet which is temporarily awaited, conveyance of a different sheet at the conveying path or at another portion requiring driving for a portion for conveying the awaited sheet is detected. An operation of conveying one or a plurality of sheets in a waiting state is resumed, and conveyance of the other sheet to the conveying path or the other portion is allowed in the above-described manner, so that sheet processing having a high degree of freedom is realized.

As described above, according to the present invention, since simultaneous discharge of sheets having different conveying conditions at a discharging portion is prohibited, it is possible to realize an excellent sheet conveying property and improvement in a sheet aligning property after sheet discharge.

DESCRIPTION OF THE PREFERRED EMBODIMENT

A sheet processing apparatus according to a preferred embodiment of the present invention is mounted in an image forming apparatus, and processes sheets discharged from the image forming apparatus.

Image Forming Apparatus

Figure 1:
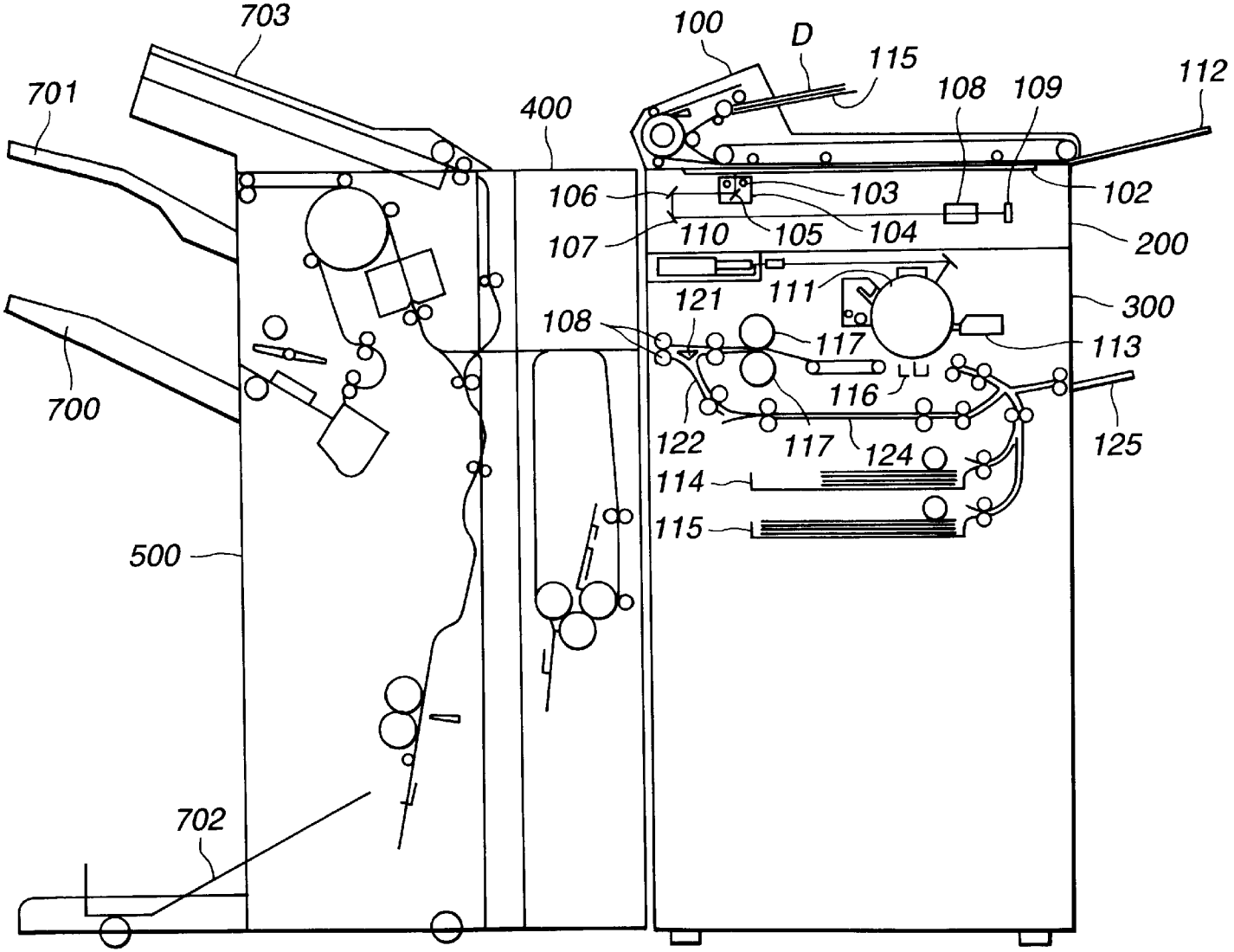
FIG. 1 is a longitudinal sectional front view of a sheet processing apparatus according to an embodiment of the present invention and a main body of an image forming apparatus including the sheet processing apparatus.

First, a main body of the image forming apparatus will be described. FIG. 1 is a diagram illustrating the configuration of the image forming apparatus and the sheet processing apparatus.

The image-forming apparatus includes an image reader 200 and a printer 300, and an original-feeding device 100 is mounted on the image reader 200. The original-feeding device 100 sequentially feeds set originals to the left starting from the leading page, conveys each of the fed originals from the left to the right on platen glass 102 via a curved path, and then discharges the original onto a discharged-sheet tray 112. At that time, a scanner unit 104 is held at a predetermined position. The original is read by being passed from the left to the right (as viewed in FIG. 1) on the scanner unit 104. This reading method is termed "original-passing reading". As the original passes, light from a lamp 103 of the scanner unit 104 is projected onto the original, and reflected light from the original is guided to an image sensor 109 via mirrors 105, 106 and 107, and a lens 108. It is also possible to read the original by stopping the original on the platen glass 102 after conveying it by the original-feeding device 100, and then moving the scanner unit 104 from the left to the right. This reading method is termed "original-fixing reading".

When reading an original without using the original-feeding device 100, the user sets the original on the platen glass 102 after raising the original-feeding device 100. In this case, original-fixing reading is performed.

The image of the original read by the image sensor 109 is transmitted to an exposure control unit 110 after being subjected to image processing. The exposure control unit 110 outputs a laser beam corresponding to an image signal representing the image. This laser beam is projected onto a photosensitive drum (image forming means) 111, and an electrostatic latent image is formed on the photosensitive drum 111. The electrostatic latent image on the photosensitive drum 111 is developed by a developing unit 113 using a developer. The developer on the photosensitive drum 111 is transferred onto a sheet fed from one of cassettes 114 and 115, a manual-insertion sheet feeding unit 125 and a duplex conveying path 124 at a transfer unit 116.

The sheet having the developer transferred thereto is subjected to developer fixing processing at a fixing unit 117. The sheet passing through the fixing unit 117 is first guided to a path 122 by a flapper 121. After the trailing edge of the sheet has passed flapper 121, the sheet is subjected to switchback, and is guided to discharging rollers 118 of the main body (discharging means of the main body) by the flapper 121. The sheet is thereby discharged from the printer 300 by the discharging rollers 118 in a state in which the surface having the developer transferred thereto is placed downward (a face-down state). Such a discharging operation is termed "reversal sheet discharging". By discharging sheets in the face-down state, a correct order of pages can be obtained when sequentially forming images from the leading page, as, for example, when using the original-feeding device 100, or when printing images output from a computer.

When forming an image on a hard sheet, such as an OHP (overhead projector) sheet or the like, from the manual-insertion sheet feeding unit 125, the sheet is discharged from the discharging rollers 118 in a state in which the surface having the developer transferred thereto is placed upward (a face-up state) without being guided to the path 122.

When forming images on both surfaces of the sheet, the sheet is directly guided from the fixing unit 117 to the discharging rollers 118. The sheet is subjected to switchback immediately after the trailing edge of the sheet has passed flapper 121, and is guided to the duplex conveying path 124 by the flapper 121.

Figures 2A, 2B, 2C, 2D, 2E, 2F, 2G, 2H:
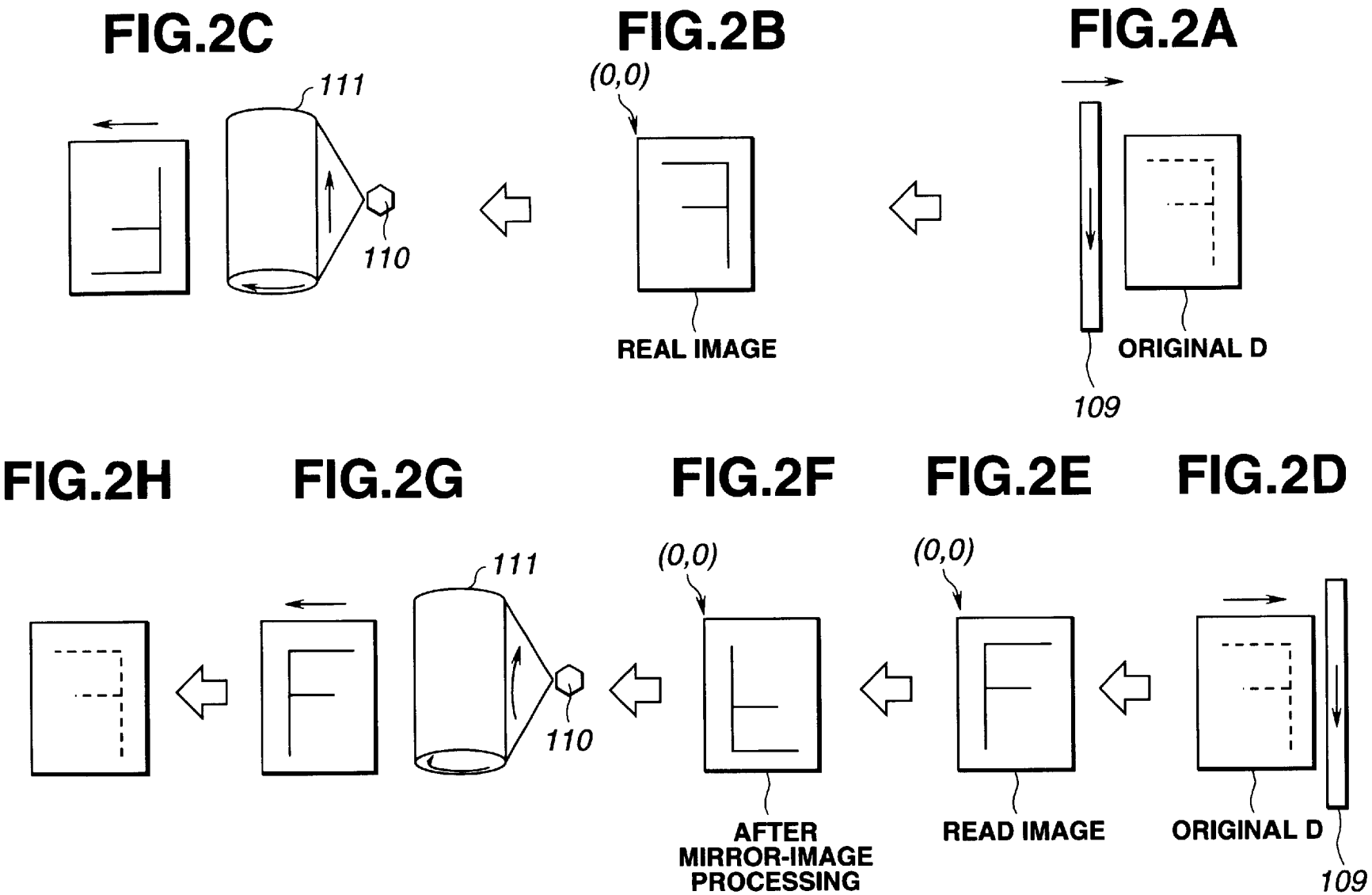
FIGS. 2A–2H are diagrams illustrating images formed in the main body of the image forming apparatus shown in FIG. 1.

As described above, in original-fixing reading, as shown in FIG. 2A, the original is read from the right end to the left end of the original in a sub-scanning direction, and an image is sequentially formed from the right end of the original. In a main scanning direction, an image read in the direction of an arrow within the image sensor 109 is formed in the direction of an arrow near the exposure control unit 110. By transmitting the image thus read to the exposure control unit 110 without being modified, the image of the original is reproduced without producing an mirror image.

In the original-passing reading, however, as shown in FIG. 2B, the original is read from the left end to the right end of the original. Hence, the sub-scanning direction is inverse to that in the original-fixing reading. If the read image is transferred to the exposure control unit 110 without being modified, a mirror image of the original image is formed. Accordingly, mirror-image processing is performed by inverting the main scanning direction, in order to obtain the correct image from the formed mirror image. By transmitting the corrected image to the exposure control unit 110, a correct image as shown in FIG. 2B is formed. When performing reversal sheet discharge in the above-described manner, the trailing-edge side of the sheet becomes the left end of the image. Accordingly, by binding the trailing-edge side, the left-end side of the image is bound. Mirror-image processing may also be performed by inverting the sub-scanning direction. However, taking into consideration that mirror-image processing cannot be performed until image reading for one page is completed, and the left-end side of the image is bound by binding the trailing-edge side of the sheet after reversal sheet discharge, it is preferable to invert the main scanning direction.

The sheet discharged from the discharging rollers 118 is fed to a folding device 400. The folding device 400 performs processing of folding the sheet in the form of Z. When folding processing is assigned for an A3-size or B4-size sheet, folding processing is performed by the folding device 400. Other sheets are directly fed to a finisher 500. The finisher 500 performs binding processing, punching processing or the like.

Figure 3:
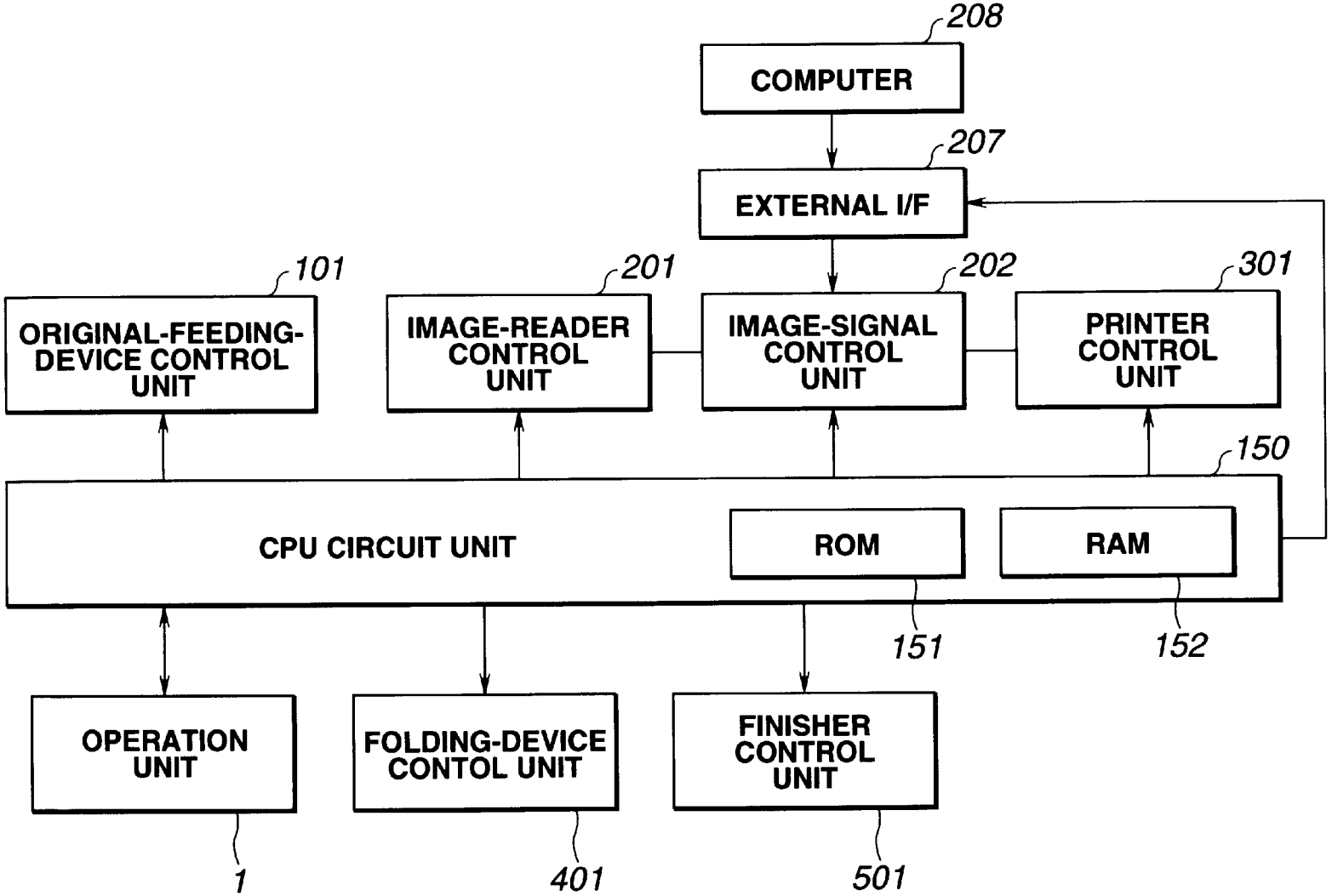
FIG. 3 is a block diagram illustrating the configuration of control in the sheet processing apparatus shown in FIG. 1.

FIG. 3 is a block diagram illustrating control for the above-described apparatus. A CPU (central processing unit) circuit unit 150 includes a CPU, and controls an original-feeding-device control-unit 101, an image-reader control unit 201, an image-signal control unit 202, a printer control unit 301, a folding-device control unit 401, a finisher control unit 501 and an external I/F (inferface) 207 in accordance with programs stored in a ROM (read-only memory) 151, and is set through an operation unit 1. The original-feeding-device control unit 101, the image-reader control unit 201, the printer control unit 301, the folding-device control unit 201, the printer control unit 301, the folding-device control unit 401 and the finisher control unit 501 control the original-feeding device 100, the image reader 200, the printer 300, the folding device 400 and the finisher 500, respectively. A RAM (random access memory) 152 is used as a region for temporarily holding control data, and an operational region for calculations relating to control. The external I/F 207 operates as an interface with a computer 208, and develops printing data into an image and outputs the developed image to the image-signal control unit 202. An image read by the image sensor 109 is transmitted from the image-reader control unit 201 to the image-signal control unit 202. An image transmitted from the image-signal control unit 202 to the printer control unit 301 is input to the exposure control unit 110.

Figure 4:
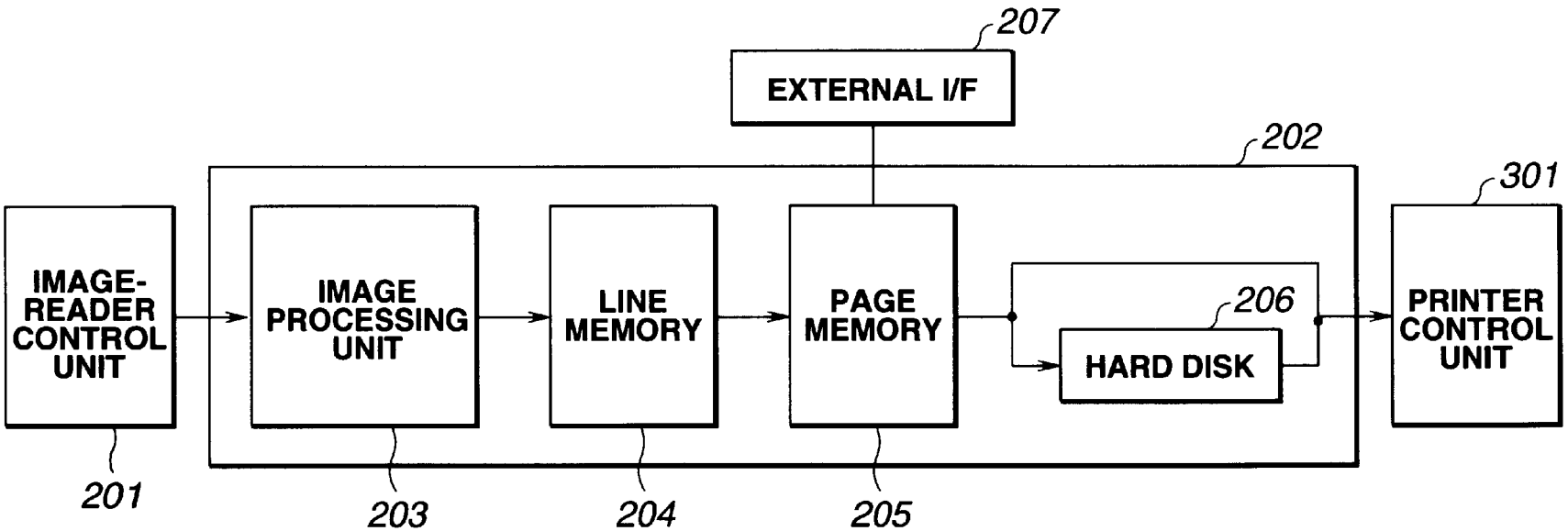
FIG. 4 is a block diagram illustrating the configuration of an image-signal processing unit, shown in FIG. 3, of the sheet processing apparatus.

FIG. 4 illustrates the configuration of the image-signal control unit 202. An image processing unit 203 performs image correction processing, and editing processing corresponding to setting through the operation unit 1. A line memory 204 performs the above-described mirror-image processing of inverting the main scanning direction. An image from the line memory 204 is output to the printer control unit 301 via a page memory 205. A hard disk 206 is used if necessary, for example, when exchanging the order of pages.

As described above, an image is formed on a fed sheet S and is discharged onto the sheet processing apparatus 1 of the embodiment.

Sheet Processing Device

The sheet processing apparatus of the embodiment will now be described with reference to FIG. 5.

Figure 5:
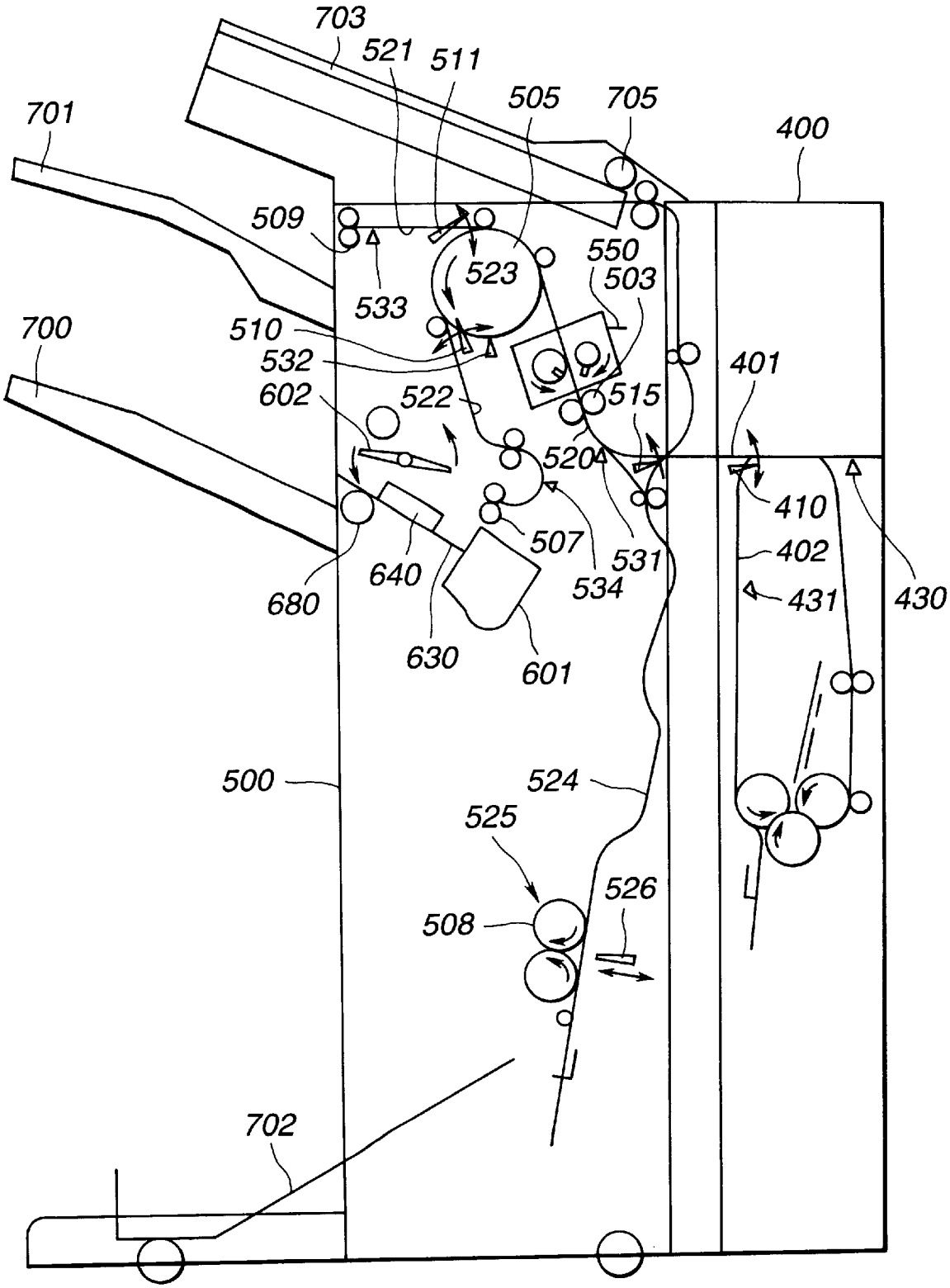
FIG. 5 is a longitudinal sectional front view illustrating the configuration of the sheet processing apparatus shown in FIG. 1.

In FIG. 5, there are shown the folding device 400 and the finisher 500.

First, the configuration of the folding device 400 will be described. The sheet discharged from the image forming apparatus is conveyed by being guided in a folding-conveyance horizontal path 401. At that time, first, an on/off state of the sheet is detected by a folding-conveyance-horizontal-path sensor 430. When not performing folding for the sheet, a folding-path selection flapper 410 is made in an off-state, and the sheet is directly conveyed to the finisher 500. When performing folding for the sheet, the folding-path selection flapper 410 is made in an on-state, and the sheet is conveyed to a folding-conveyance folding path 402. By making the folding-path selection flapper 410 in an off-state after performing folding processing, the sheet is conveyed to the finisher 500. Within the folding-conveyance folding path 402, a folding-conveyance folding-path sensor 431 is used for detecting the timing of sheet conveyance, a sheet jam, and the like.

Next, the finisher 500 will be described.

The sheet conveyed to the finisher 500 is first conveyed to a saddle selection flapper unit 515. When the saddle selection flapper unit 515 is in an on-state, the sheet is fed to a "saddle conveyance path 524", serving as a conveyance path for binding processing. The binding processing will be described later.

In FIG. 5, there are also shown conveying rollers 503, an inlet-sheet-conveying-path sensor 531, and a punching unit 550 for punching the conveyed sheet. A large conveying roller (sheet conveying means) 505 conveys the sheet by pressing the sheet with a pressing roller contacting the large conveying roller 505. Discharging rollers 509 discharge the sheet onto a sample tray 701 using a conveying path 521. A switching flapper 511 performs switching between a sample path 521 and a sorting path 522. A switching flapper 510 performs switching between the sorting path 522 and a buffer path 523 for temporarily storing the sheet. An intermediate tray (hereinafter termed a "processing tray") 630 temporarily accumulates sheets in order to align and staple the sheets. Discharging rollers 507 discharge the sheet onto the processing tray 630. A bundle discharging roller (feeding means) 680 conveys a bundle of sheets on the processing tray 630 and discharges the bundle onto a stack tray 700. A stapler 601 staples the bundle of sheets on the processing tray 630, and can move in a direction substantially orthogonal to the sheet conveying direction. By moving along an end portion of the bundle of sheets, the stapler 601 can staple the bundle, for example, at two portions of the end portion.

Members 640 provided at the front side and the rear side of the apparatus align a direction substantially orthogonal to the conveying direction of the sheets discharged onto the processing tray 630. By adjusting the aligning position of the sheets, offset (at the front side or the rear side) on the processing tray 630 can be provided.

Next, a description will be provided of the stack tray 700 and a sample tray 701.

Each of these trays has an independent motor so as to be able to perform independent movement in a vertical direction.

Next, the punching unit 550 will be described.

The punching unit 550 includes punching means and lateral-registration detection means. The punching means includes a punch and a dice meshed with each other which can be rotated by driving of a punch driving motor. During a punching operation, after detecting the trailing edge of the sheet, the punch driving moter is driven at a predetermined timing in order to punch the sheet being conveyed. At that time, by making the rotational speed of the punch and the die to be the same as the rotational speed of the above-described conveying rollers, the sheet being conveyed can be punched. There is also provided a sensor (not shown) for detecting a rear end portion of the sheet being conveyed. By moving the entire punching unit 550 in a direction orthogonal to the sheet conveying direction, stopping the lateral movement of the punching unit 550 when detecting the end portion of the sheet, and punching the sheet at that position, alignment of the sheet in a lateral direction can be effected.

The entire movement of the apparatus will now be described with reference to flowcharts.

Processing of Determining the Operational Mode

Figure 6:
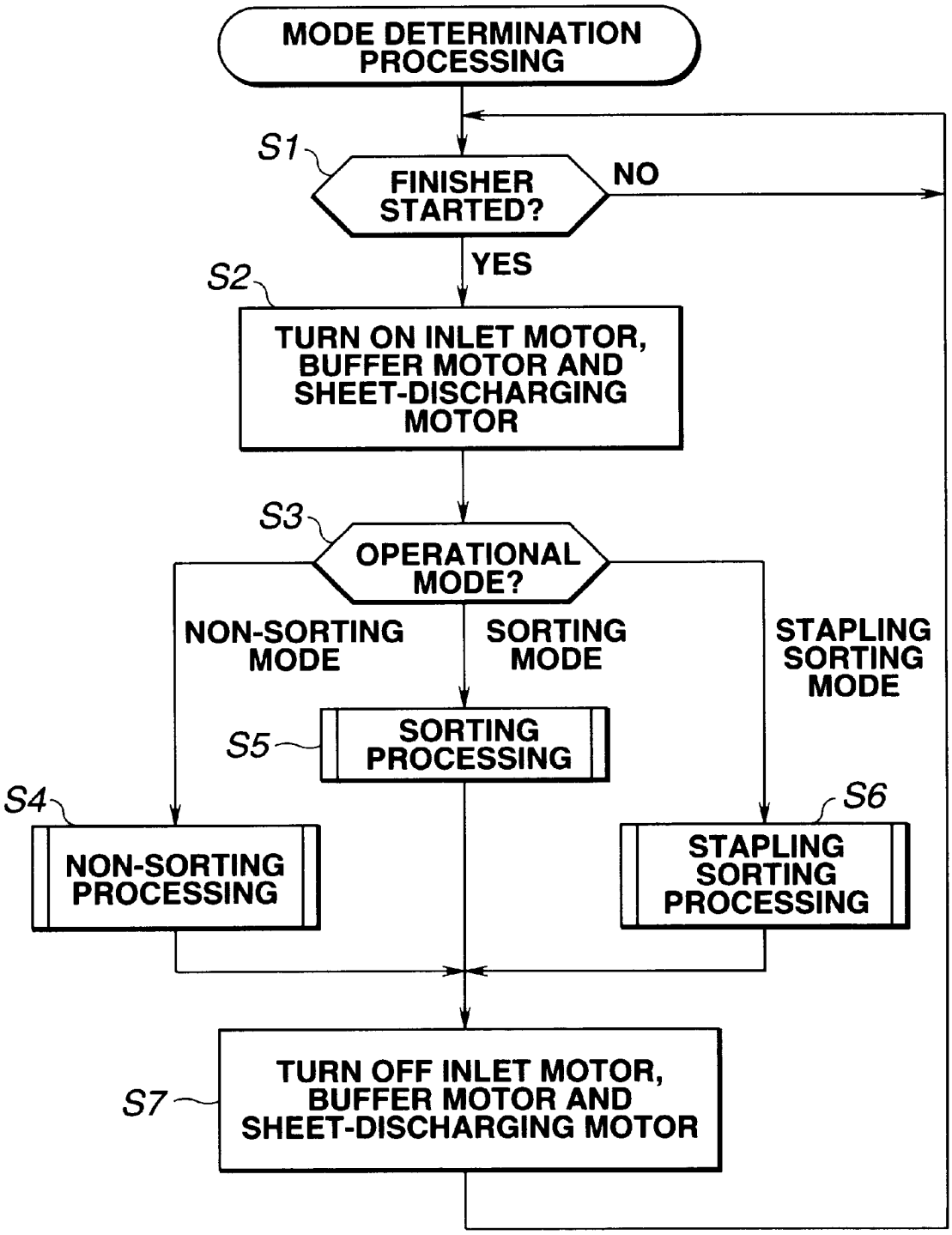
FIG. 6 is a flowchart illustrating mode determination processing of the sheet processing apparatus shown in FIG. 1.

Processing of determining the mode of an operation will be described with reference to the flowchart shown in FIG. 6.

First, in step S1, it is determined if the finisher 500 has started. When a start key for a copying operation has been depressed on an operation unit (not shown) on the main body of the image forming apparatus, and a signal for starting the operation of the finisher 500 has been input from the main body of the image forming apparatus to a CPU of the finisher 500 via a communication IC (integrated circuit), start of the finisher 500 enters an on-state, and an inlet motor, a buffer motor and a sheet discharging motor start driving (step S2). If the starting signal is not input, the finisher 500 continues in a waiting state.

Then, in step S3, the operational mode is determined. The process proceeds to non-sorting processing (see FIG. 7), sorting processing (see FIG. 8), and stapling sorting processing (see FIG. 9) if the operational mode is a non-sorting mode, a sorting mode and a stapling sorting mode, respectively.

Upon completion of one of the above-described sets of processing, the driving of the inlet motor, the buffer motor and the sheet-discharging motor is stopped (step S7), and the finisher 500 returns to the waiting state.

Non-sorting Processing

Figure 7:
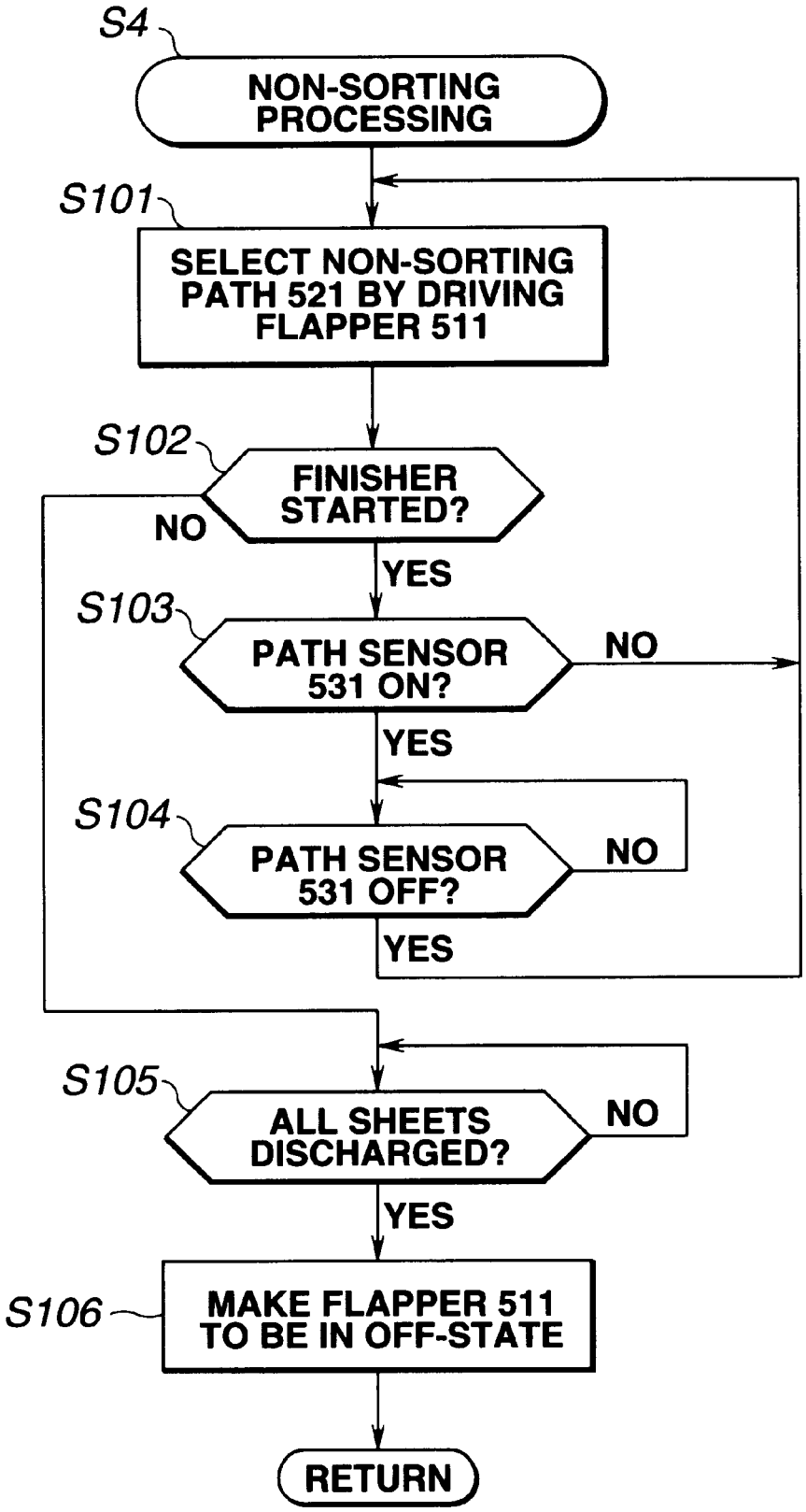
FIG. 7 is a flowchart illustrating non-sorting processing of the sheet processing apparatus shown in FIG. 1.

The non-sorting processing will be described with reference to the flowchart shown in FIG. 7.

When the process has proceeded to the non-sorting processing as a result of the above-described processing of determining the operational mode, the non-sorting path (sample path) 521 is selected by driving the flapper 511 in order to guide the sheet onto the sample tray 701 (step S101). At that time, since binding is not performed, a flapper 515 is operated so as to pass the sheet to a conveying path 520.

In step S102, it is determined if the finisher 500 has been started. If the result of the determination in step S102 is affirmative, the sheet discharged from the main body of the image forming apparatus is conveyed to the sheet path within the finisher 500. The conveyed sheet is further conveyed by the inlet motor. In step S103, it is determined if the leading edge of the sheet has been detected by a path sensor 531 provided within the sheet path. If the result of the determination in step S103 is affirmative, the process proceeds to step S104, where it is determined if the sheet has been further conveyed and the trailing edge of the sheet has passed through the path sensor 531 to turn off the path sensor 531.

If the result of the determination in step S104 is affirmative, the process returns to step S101 and then proceeds to step S102. If the result of the determination in step S102 is negative, the process proceeds to step S105, where it is determined if all sheets has been discharged onto the sample tray 701. If the result of the determination in step S105 is affirmative, the process proceeds to step S106, where the operation of the flapper 511 is released, and the non-sorting processing is terminated.

Sorting Processing

Figure 8:
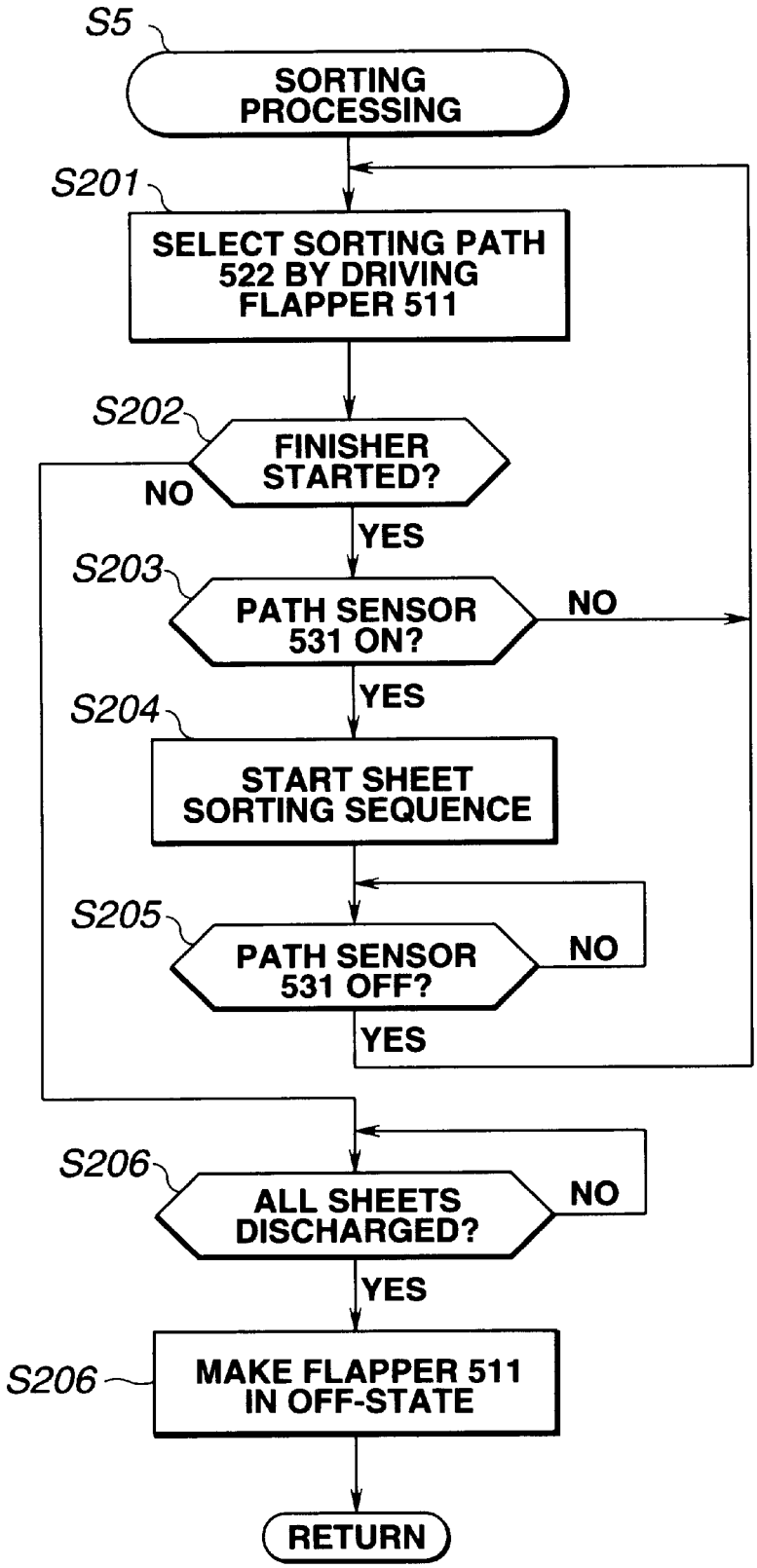
FIG. 8 is a flowchart illustrating sorting processing of the sheet processing apparatus shown in FIG. 1.

The sorting processing will be described with reference to the flowchart shown in FIG. 8.

When the process proceeds to the sorting processing in the above-described operational-mode determination processing, in order to guide the sheet to the processing tray 630, the sorting path 522 is selected by driving the flapper 511 (step S201). At that time, since binding is not performed, the flapper 515 is operated so as to pass the sheet to the conveying path 520.

In step S202, it is determined if the finisher 500 has been started. If the result of the determination in step S202 is affirmative, the sheet discharged from the main body of the image forming apparatus is conveyed to the sheet path within the finisher 500.

The conveyed sheet is further conveyed by the inlet motor. In step S203, it is determined if the leading edge of the sheet has been detected by the path sensor 531. If the result of the determination in step S203 is affirmative, the process proceeds to step S204, where a sheet sorting sequence is started. The process then proceeds to step S205, where it is determined if the sheet has been further conveyed and the trailing edge of the sheet has passed through the path sensor 531 to turn off the path sensor 531.

If the result of the determination in step S205 is affirmative, the process returns to step S201 and then proceeds to step S202. If the result of the determination in step S202 is negative, the process proceeds to step S206, where it is determined if all sheets has been discharged onto the processing tray 630. If the result of the determination in step S206 is affirmative, the process proceeds to step S207, where the operation of the flapper 511 is released, and the sorting processing is terminated.

Stapling Sorting Processing

Figure 9:
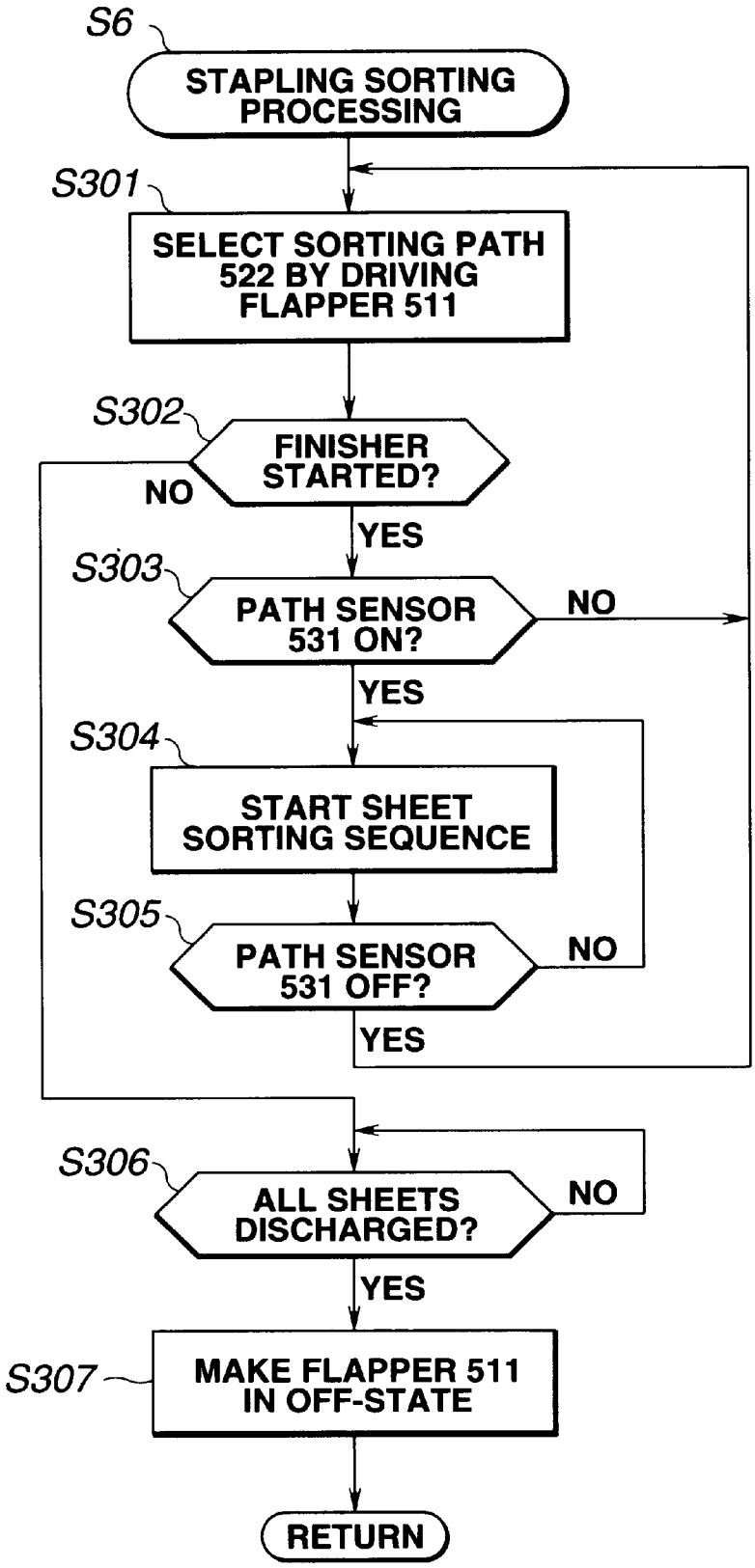
FIG. 9 is a flowchart illustrating stapling sorting processing of the sheet processing apparatus shown in FIG. 1.

The stapling sorting processing will be described with reference to the flowchart shown in FIG. 9.

When the process proceeds to the stapling sorting processing in the above-described operational-mode determination processing, in order to guide the sheet to the processing tray 630, the sorting path 522 is selected by driving the flapper 511 (step S301). At that time, since binding is not performed, the flapper 515 is operated so as to pass the sheet to the conveying path 520.

In step S302, it is determined if the finisher 500 has been started. If the result of the determination in step S302 is affirmative, the sheet discharged from the main body of the image forming apparatus is conveyed to the sheet path within the finisher 500. The conveyed sheet is further conveyed by the inlet motor. In step S303, it is determined if the leading edge of the sheet has been detected by the path sensor 531. If the result of the determination in step S303 is affirmative, the process proceeds to step S304, where a sheet sorting sequence is started.

The process then proceeds to step S305, where it is determined if the sheet has been further conveyed and the trailing edge of the sheet has passed through the path sensor 531 to turn off the path sensor 531. If the result of the determination in step S305 is affirmative, the process returns to step S301 and then proceeds to step S302. If the result of the determination in step S302 is negative, the process proceeds to step S306, where it is determined if all sheets have been discharged onto the processing tray 630. If the result of the determination in step S306 is affirmative, the process proceeds to step S307, where the operation of the flapper 511 is released, and the stapling sorting processing is terminated.

Sheet Sorting Sequence Processing

Figure 10:
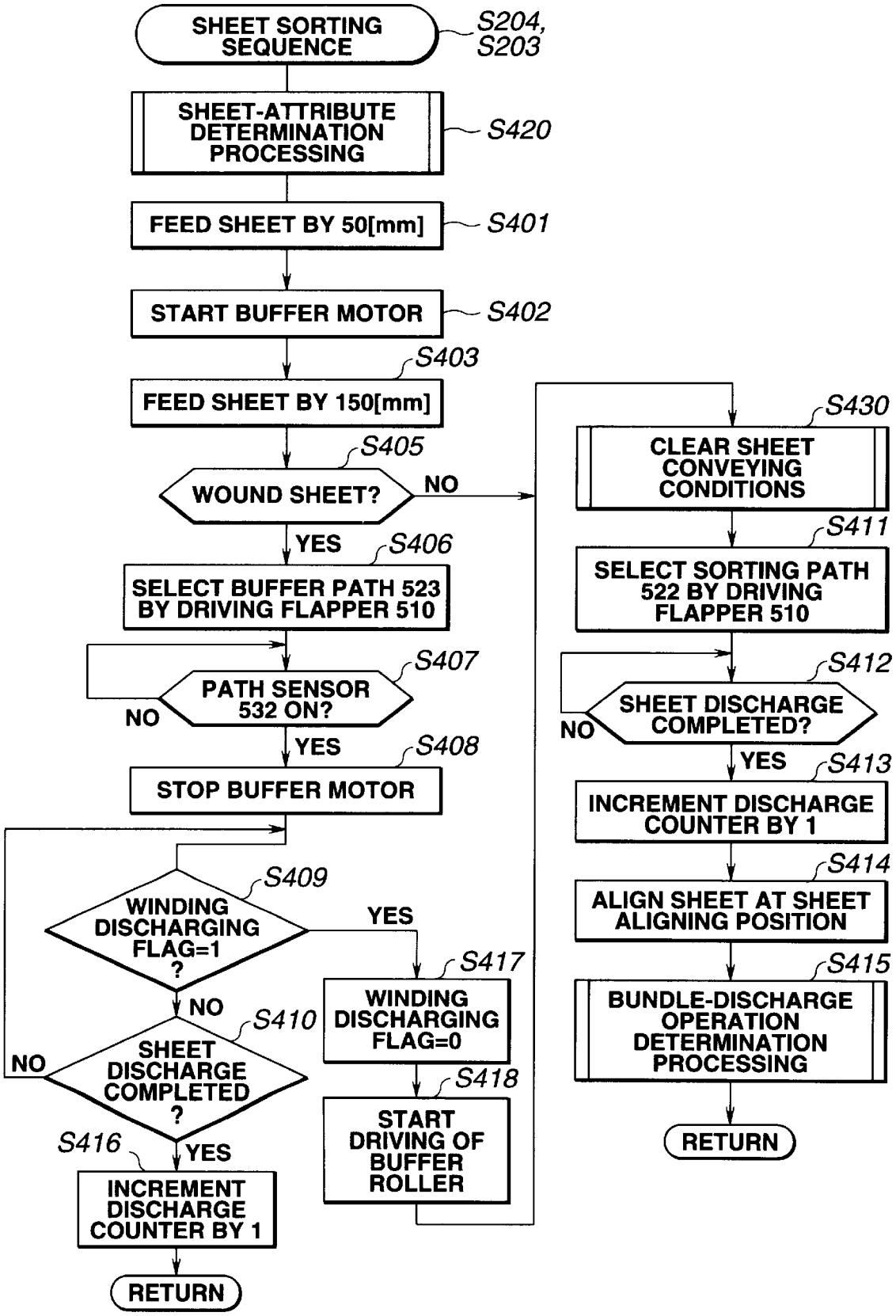
FIG. 10 is a flowchart illustrating a sheet sorting sequence of the sheet processing apparatus shown in FIG. 1.

Next, a description will be provided of the processing of a sheet sorting sequence with reference to the flowchart shown in FIG. 10.

This processing is started from the sorting processing or the stapling sorting processing, and is allocated to each conveyed sheet. The program for this processing is processed according to multitasking.

First, in step S420, sheet-attribute determination processing is performed in the finisher 500. Although the details of this processing will be described later, this is processing of determining the attribute of the conveyed sheet, such as whether the sheet is "a sheet to be wound" or "a sheet to be discharged as a bundle" after accummulating sheets as a bundle on the processing tray 630.

Then, in step S401, the sheet is conveyed by 50 mm. The process then proceeds to step S402, where the buffer motor is started. The sheet sorting sequence is started when the path sensor 531 has been turned on. The buffer motor is started when the sheet has been conveyed by 50 mm to the downstream side from the position where the leading edge of the sheet has turned on the path sensor 531. This operation is performed for the subsequent sheet conveyance and in order to provide a timing for restarting a "wound sheet" (to be described later) which is stopped in a state of being wound around a buffer roller. According to this operation, it is possible to convey the sheet together with the "wound sheet" in a superposed state. Although in this case, 50 mm is selected as the condition for providing the timing, any other value may be selected. The process then proceeds to step S403, where the sheet is further conveyed by 150 mm.

The process then proceeds to step S405, where it is determined if the sheet is assigned as a wound sheet. If the result of the determination in step S405 is affirmative, the process proceeds to step S406. If the result of the determination in step S405 is negative, the process proceeds to step S430.

Processing starting from step S406 is an operation for the "wound sheet". First, in step S406, the buffer path 523 is selected by driving the flapper 510. It is thereby possible to guide the sheet to the conveying path (buffer path) 523 for winding the sheet around the buffer roller. When a path sensor 532 provided in the buffer path 523 is turned on, control of stopping the buffer motor is started (steps S407 and S408). As a result, the leading edge of the sheet stops after passing through the path sensor 532. No problem will arise if this amount of overrun is taken into consideration when performing the above-described winding control.

Two types of approaches can be considered after stopping the buffer roller.

In the first approach, the wound sheet waits in a state of being wound around the buffer roller until the succeeding sheet causes the buffer roller to restart, and is then discharged together with the succeeding sheet.

In the second approach, the buffer roller is automatically restarted by some event, and the sheet is discharged.

In this embodiment, a "winding discharging flag" shown in the flowchart of FIG. 10 indicates automatic sheet discharge caused by an "event".

In the first approach, since this flag is not set, the process proceeds from step S409 to step S410, and monitoring is performed until completion of sheet discharge.

Upon completion of sheet discharge onto the processing tray 630 after restarting the buffer roller, the value of a discharge counter is incremented by one, and the process is terminated (steps S410 and S416).

The second approach will be described later.

Figure 16:
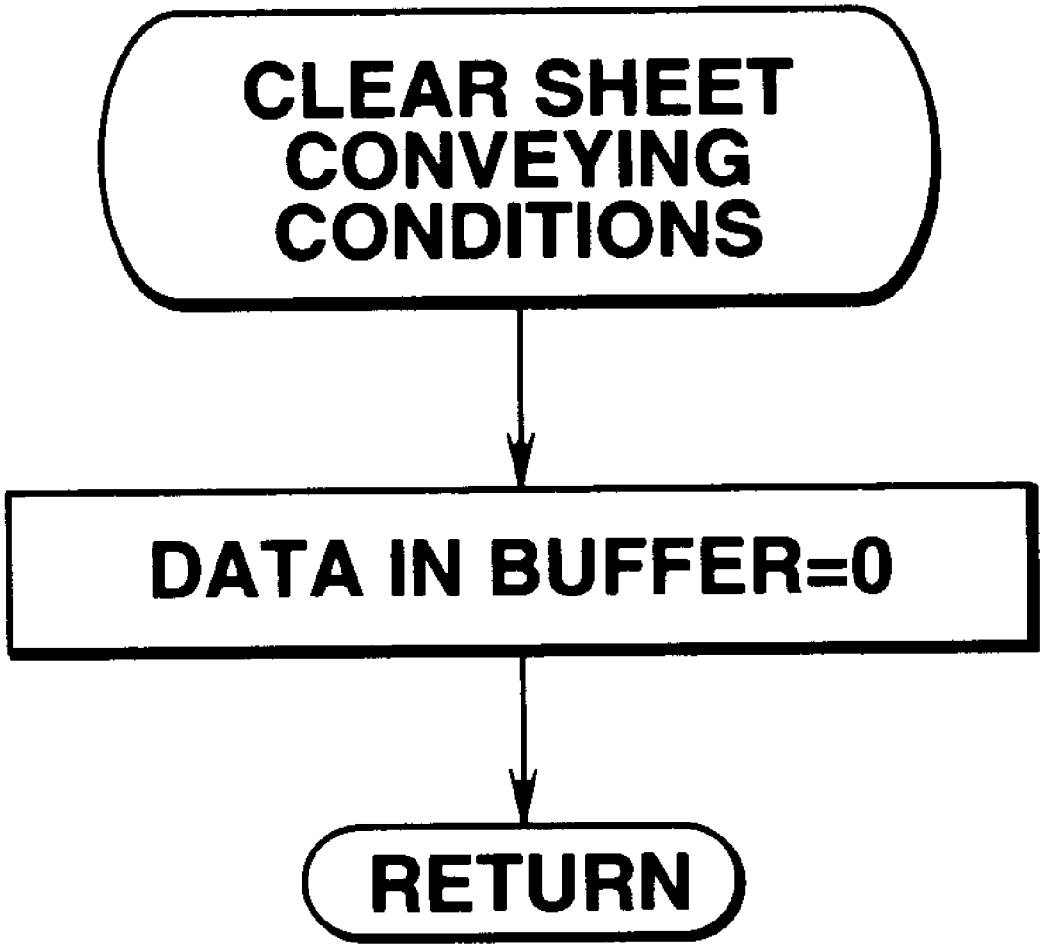
FIG. 16 is a flowchart illustrating clearing of sheet conveying conditions of the sheet processing apparatus shown in FIG. 1.

If the result of the determination in step S405 is negative, the process proceeds to step S430, where sheet conveying conditions are cleared. This processing is briefly shown in FIG. 16. In this processsing, data stored in the buffer storage indicating the sheet conveying conditions is cleared. This data is used in sheet-attribute determination processing.

In step S411, the sorting path 522 is selected by driving the flapper 510. The sheet is thereby guided to the path 522, serving as a discharging path to the processing tray 630, instead of being guided to the above-described buffer path. After confirming completion of sheet discharge onto the processing tray 630 (step S412), the value of the discharge counter is incremented by one (step S413), an aligning operation is performed (step S414), bundle-discharge-operation determination processing (to be described later) is performed (step S415), and the process is terminated.

In the above-described operation of discharging the sheet onto the processing tray 630, alignment of the sheet conveying direction is performed by performing an operation of aligning the sheet in a direction substantially orthogonal to the sheet conveying direction simultaneously with the sheet discharge and rotating a paddle. A detailed description of this operation will be omitted.

A description will now be provided of the above-described second approach after winding the sheet around the buffer roller and stopping the buffer motor. In this case, since a "winding discharging flag" indicating sheet discharge from the buffer roller is set, the process proceeds from step S409 to step S417, where the "winding discharging flag" is reset, and driving of the buffer roller for sheet discharge is started (step S418). Thereafter, as in the above-described case of "not a wound sheet", the flapper is switched, and the processing of discharging the sheet onto the processing tray 630 is performed (steps S430, S411, S412, S413, S414 and S415).

By thus performing control so as to allow automatic sheet discharging processing, it is possible to prevent inferior sheet alignability on the processing tray 630 which may occur, for example, when misalignment in the conveying speed or the like is present between a plurality of sheets which are simultaneously discharged.

Sheet-attribute Determination Processing

Next, the above-described sheet-attribute determination processing will be described in detail with reference to the flowchart shown in FIG. 11.

Figure 12:
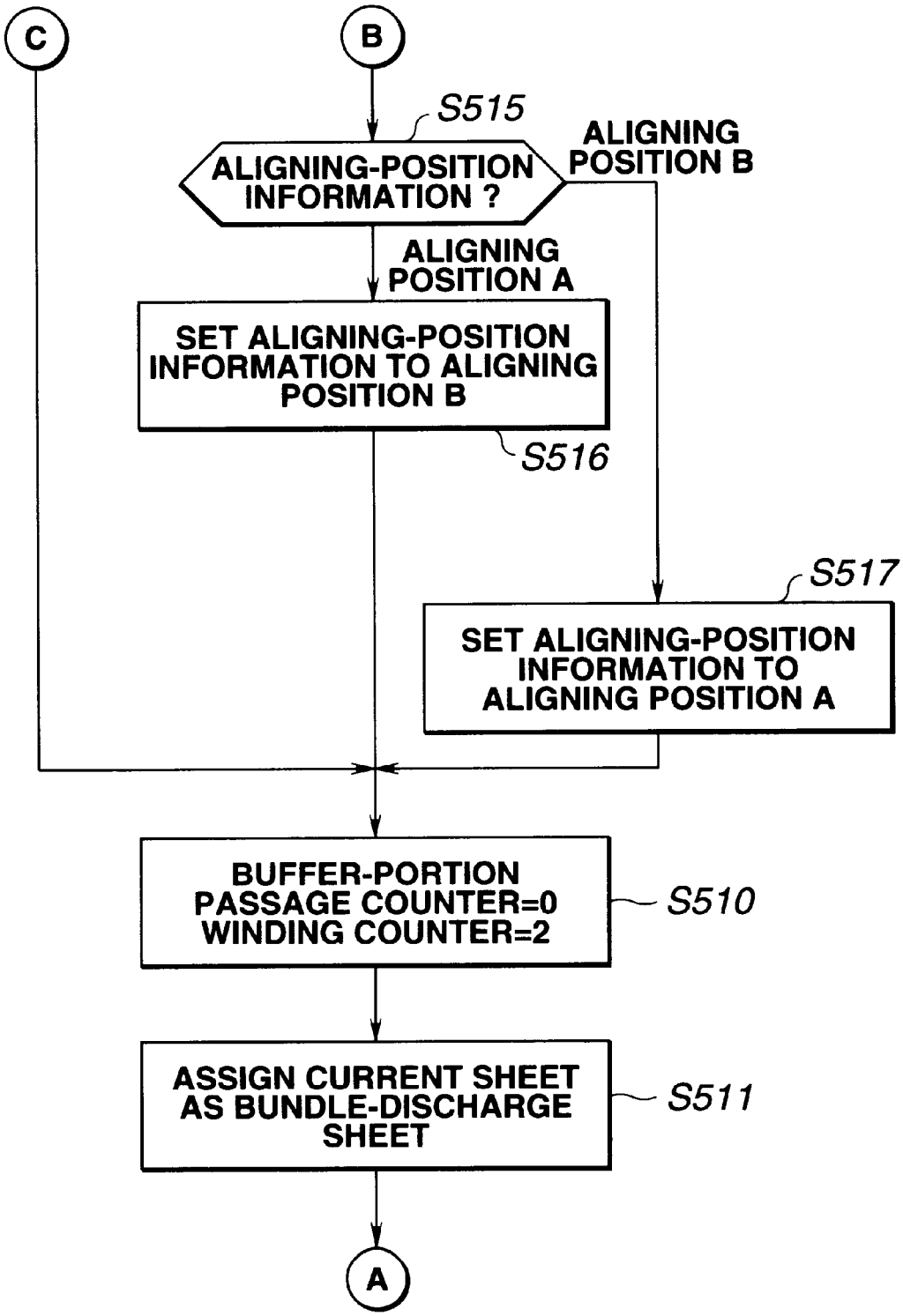

First, in step S501, the value of a buffer-portion pass counter is incremented by one. Then, in step S502, it is determined if the current sheet is the last sheet of a bundle. The bundle is a unit of sorting in the sorting mode, and a unit of stapling in the stapling sorting mode. If the result of the determination in step S502 is affirmative, the process proceeds to step S515 in FIG. 12. If the result of the determination in step S502 is negative, the process proceeds to step S503. In step S503, it is determined if the size of the sheet is a size capable of being wound. If the result of the determination in step S503 is affirmative, the process proceeds to step S504. If the result of the determination in step S503 is negative, the process proceeds to step S513. In step S504, it is determined if the value of a "winding counter" indicating the number of sheets capable of being wound equals 0. If the result of the determination in step S504 is negative, the process proceeds to step S505, where the value of the counter is decremented by one. Then, the process proceeds to step S506, where sheet-conveying-condition determination processing (by sheet-conveying-condition detection means) is performed. In this processing, it is determined if the current sheet is to be assigned as a "wound sheet". This processing will be described later. Then, the process is terminated.

The object of providing a wound sheet is to give time allowance at processing at the downstream side by temporarily holding the conveyed sheet and discharging the sheet simultaneously with the succeeding sheet, and thereby to improve productivity. If the result of the determination in step S504 is affirmative, the process proceeds to step S507, where it is determined if the operational mode is the sorting mode. If the result of the determination in step S507 is negative, i.e., if the operational mode is the stapling mode, the process proceeds to A as indicated in the flowchart, and the process is terminated. If the result of the determination in step S507 is affirmative, determination processes in steps S508, S509 and S512 are performed. When "the value of the buffer-portion passage counter is 4" and the sheet is "the second sheet before the last sheet of the bundle" in these processes, the process proceeds to step S510, where the sheet is assigned as a "bundle discharge sheet" indicating discharge of a sheet bundle from the processing tray 630. The same processing is also performed when the "the value of the buffer passage counter is 5". In cases other than the above-described cases, the processing is terminated.

In step S513, it is determined if the operational mode is the sorting mode. If the result of the determination in step S513 is affirmative, the process proceeds to step S514. If the result of the determination in step S513 is negative, i.e., if the operational mode is the stapling mode, the process is terminated. In step S514, it is determined if the value of the buffer-portion passage counter is 3. If the result of the determination in step S514 is negative, the process is terminated. If the result of the determination in step S514 is affirmative, the process of steps S510 and S511 are performed. In steps S510 and S511, processing of assigning the sheet as a "bundle-discharge sheet" indicating discharge of a bundle of sheets, and processing of performing setting in counters in accordance with the assignment (clearing of the buffer-portion passage counter and setting in the winding counter) are performed. The assignment of a "bundle-discharge sheet" indicates start of an operation of discharging a bundle from the processing tray 630 to the stack tray 700 when the sheet is discharged/mounted on the processing tray 630, and is used in the flowchart of "bundle-discharge-operation determination processing" (to be described later).

In steps S515, S516 and S517, setting of the direction of offset on the processing tray 630 is performed. Namely, "aligning-position information" indicating the direction of offset when this processing is executed is set as alignment-offset information of the sheet. The aligning-position information" indicating the direction of offset is inverted by the last sheet, and "mounting in a shifted state" on the pocessing tray 630 is realized.

Next, sheet-conveying-condition determination processing (S506) will be described with reference to FIG. 15.

In step S801, it is determined if a sheet set as a "wound sheet" is present before the current sheet. In this embodiment, this process is performed in order to determine if conveying conditions for a plurality of sheets to be wound are identical. If the result of the determination in step S801 is negative, the conveying condition of the sheet is set in a buffer storage (step S802), and the sheet is assigned as the first sheet to be wound (step S803).

If the result of the determination in step S802 is affirmative, it is then determined if the "sheet conveying condition" of the preceding sheet set as the wound sheet equals the conveying condition of the current sheet stored in the buffer storage (step S804). If the result of the determination in step S804 is affirmative, processing of winding the current sheet is performed (step S803). If the result of the determimation in step S804 is negative, a "winding discharging flag" instructing discharge of the preceding wound sheet from the buffer roller is set (step S805). Then, setting of data relating to winding is performed (step S806). Thus, winding processing is not performed until a condition allowing subsequent winding is set.

As described above, in this embodiment, the "sheet conveying speed" is set as the sheet conveying condition. Namely, if a plurality of different sheets having different conveying speeds are conveyed, inferior conveyance of sheets and inferior alignment on the processing tray will occur.

The processing of determining/setting the attribute of the sheet (whether winding control is to be performed or bundle discharge is to be performed) is completed in the above-described manner.

Figure 11:
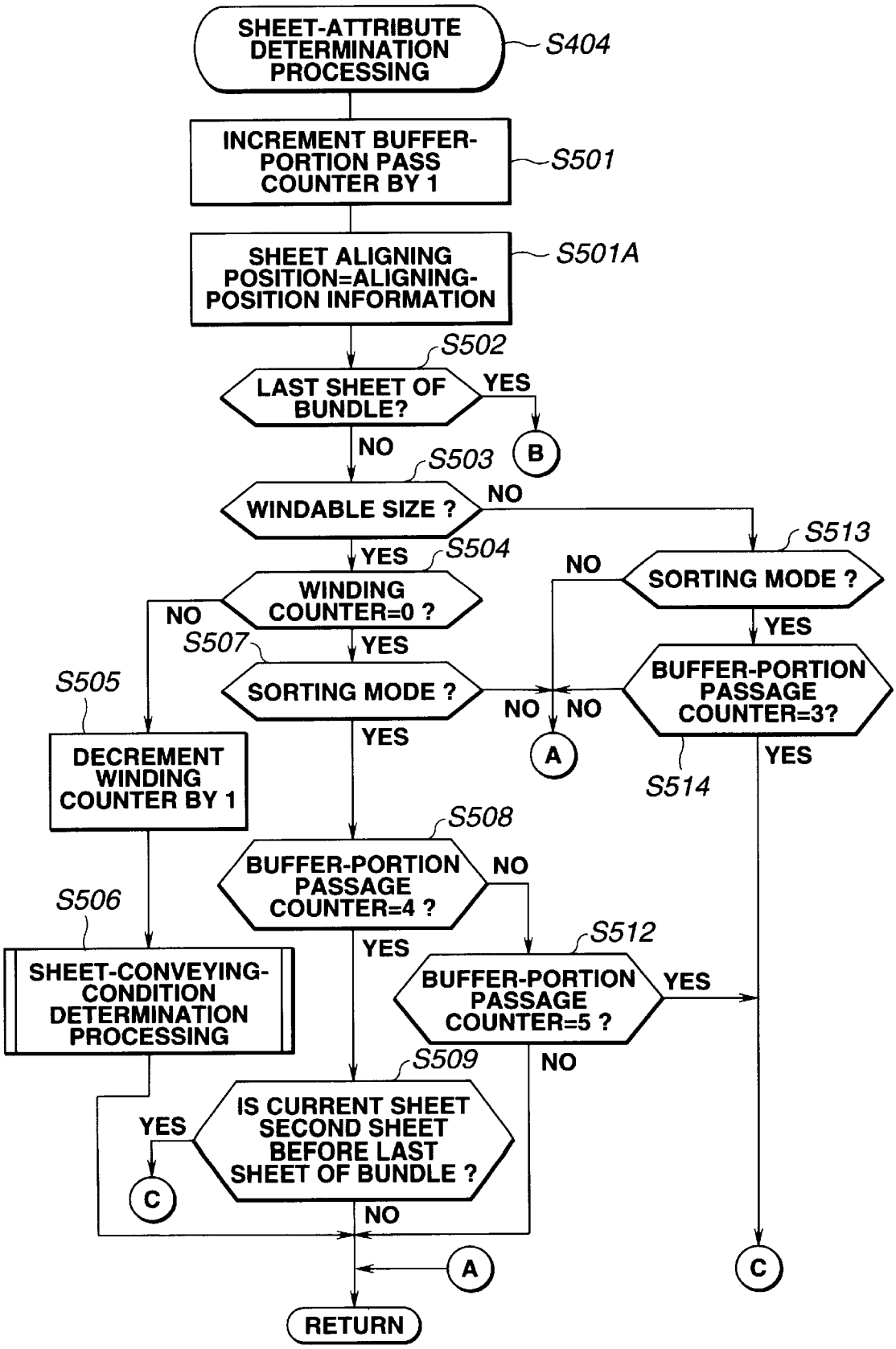
FIGS. 11 and 12 are flowcharts illustrating sheet-attribute determination processing of the sheet processing apparatus shown in FIG. 1.
Figure 15:
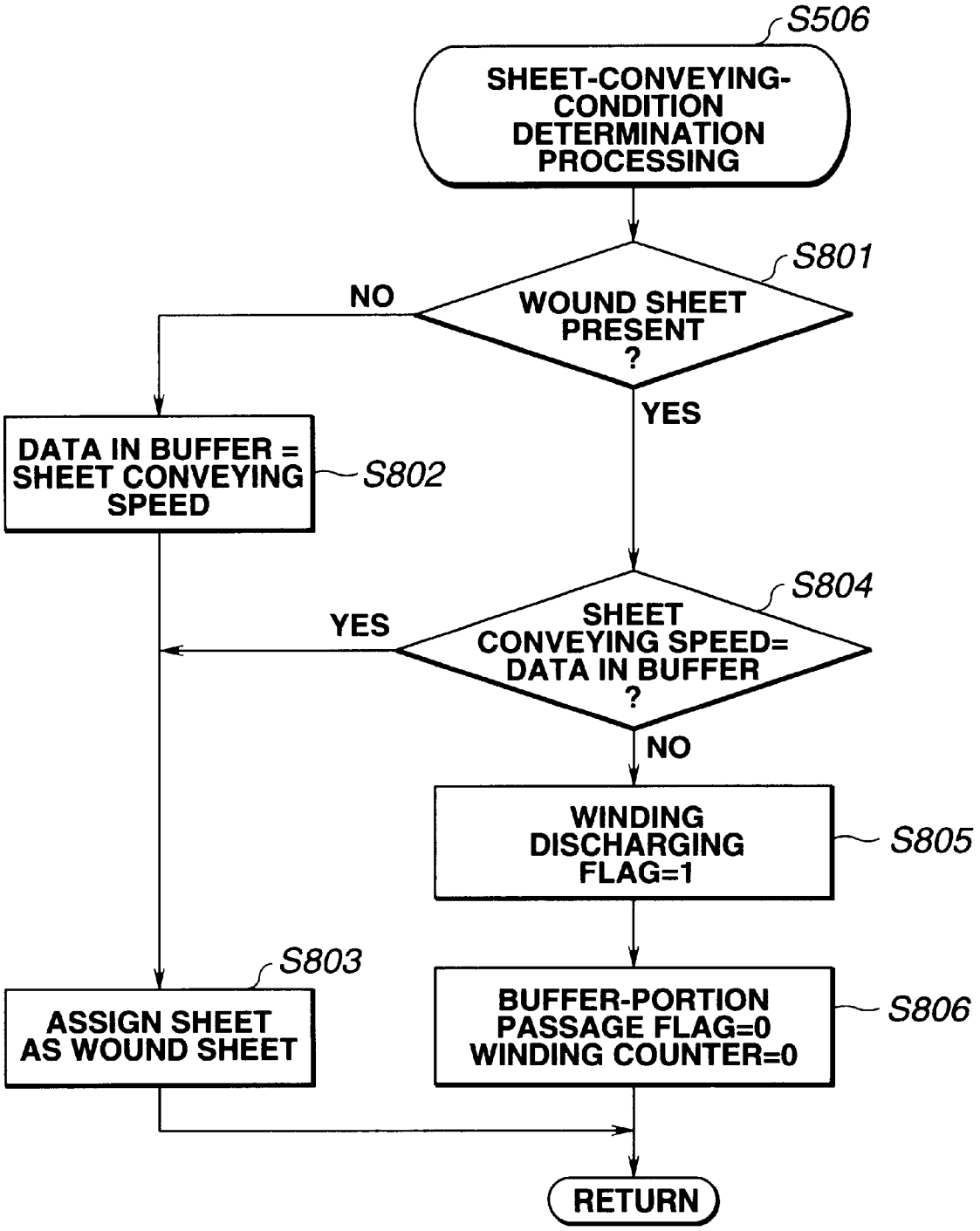
FIG. 15 is a flowchart illustrating sheet-conveying-condition determination processing of the sheet processing apparatus shown in FIG. 1.

In the foregoing description, detection of the difference in the sheet conveying speed has been set as means for detecting the sheet conveying condition in the sheet-conveying-condition determination processing performed in step S505 of FIG. 11 or in FIG. 15. However, detection of the difference in the size of the conveyed sheet, detection of stop of a sheet due to an event at a conveying path other than the large conveying roller 505 which serves as sheet conveying means, detection of the trays 700 and 701 where the sheet is to be discharged, detection of the difference in the material of the conveyed sheet, detection of the difference in the job of the sheet, detection of the difference in the mass of the conveyed sheet, or detection that the conveyed sheet has a binding mode may also be used as the sheet-conveying-condition detection means.

Means for detecting that the conveyed sheet is one of an OHP sheet, an inserter sheet, a cover, a synthetic sheet and a back cover of bound sheets, and a sheet for an interrupt operation may be used as the above-described sheet-conveying-condition detection means.

Bundle-discharging-operation Determination Processing

Figure 13:
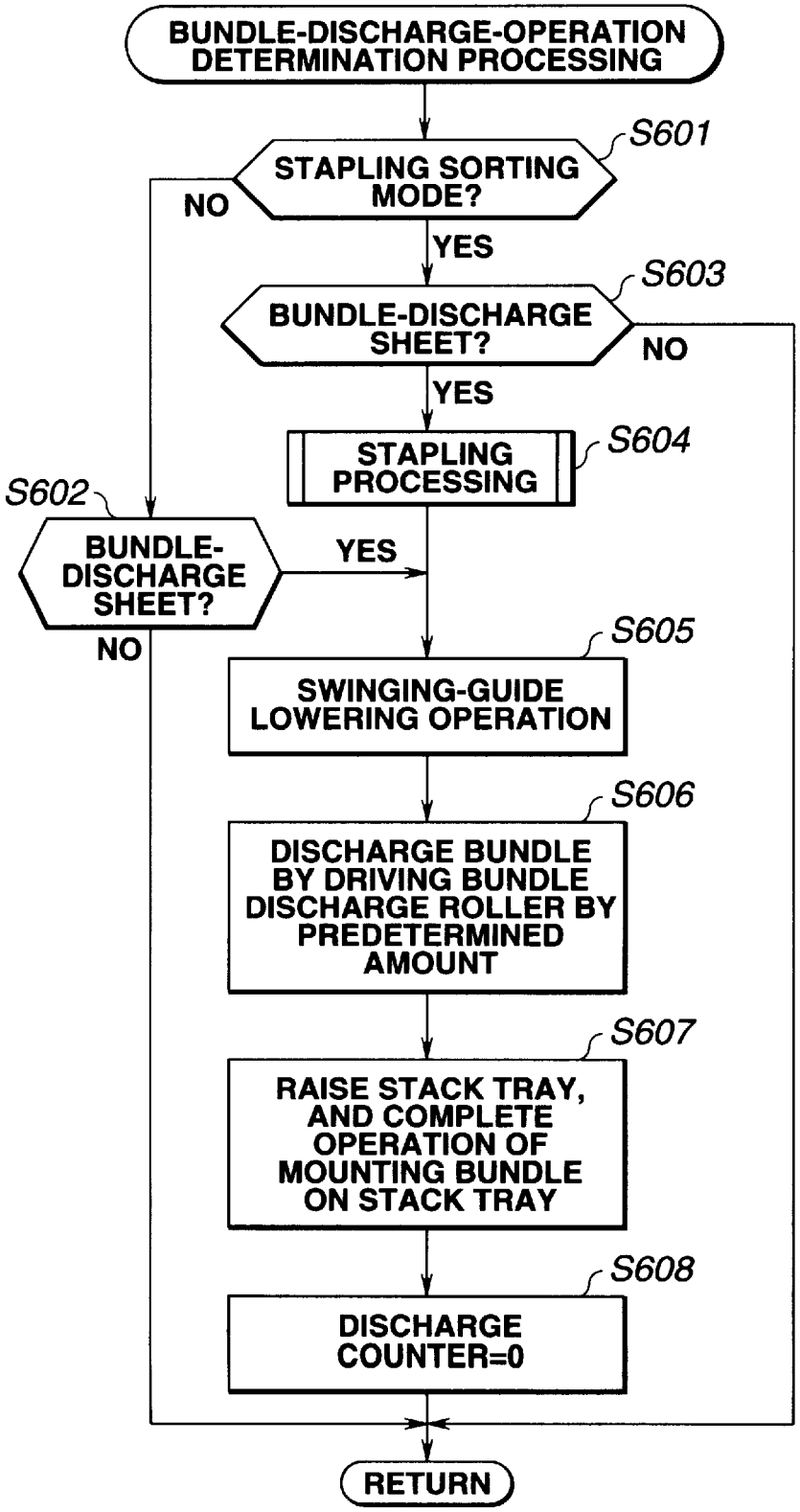
FIG. 13 is a flowchart illustrating bundle-discharge-operation determination processing of the sheet processing apparatus shown in FIG. 1.

Bundle-discharging-operation determination processing will be described with reference to the flowchart shown in FIG. 13.

When the process proceeds to bundle-discharging operation determination processing in the above-described sheet sorting sequence, it is then determined if the operational mode is the stapling sorting mode (step S601). If the result of the determination in step S601 is negative, it is then determined if the sheet discharged onto the processing tray 630 is a bundle-discharge sheet (step S602). If the result of the determination in step S602 is negative, the bundle-discharging-operation determination processing is terminated, and the process returns to the above-described sheet sorting sequence.

If the result of the determination in step S602 is affirmative, a bundle-discharge upper roller is brought in contact with the sheet bundle on the processing tray 630 by operating a swinging guide (step S605). Then, after awaiting attenuation of bounding of the bundle-discharge upper roller, the bundle of sheets on the processing tray 630 is discharged onto the stack tray 700 by driving the bundle-discharge upper roller by a predetermined amount while controlling the speed of the bundle discharging roller 680 (step S606).

Then, the stack tray 700 is raised, and an operation of mounting the bundle on the stack tray 700 is completed (step S607). Then, the discharge counter is set to 0 (step S608), and the bundle-discharging-operation determination processing is terminated.

If the result of the determination in step S601 is affirmative, it is then determined if the sheet discharged onto the processing tray 630 is a bundle-discharge sheet (step S603). If the result of the determination in step S603 is negative, the bundle-discharge-operation determination processing is terminated, and the process returns to the above-described sheet sorting sequence.

If the result of the determination in step S603 is affirmative, the process proceeds to a stapling processing sequence (step S604). Upon completion of the processing of stapling the sheet bundle on the processing tray 630, the process proceeds to step S605, where an operation of lowering the swinging guide is performed, and the above-described bundle discharging operation (from step S605 to step S608) is performed, and the bundle-discharging-operation determination processing is terminated. The process then proceeds to the sheet sorting sequence.

Stapling Processing

Figure 14:
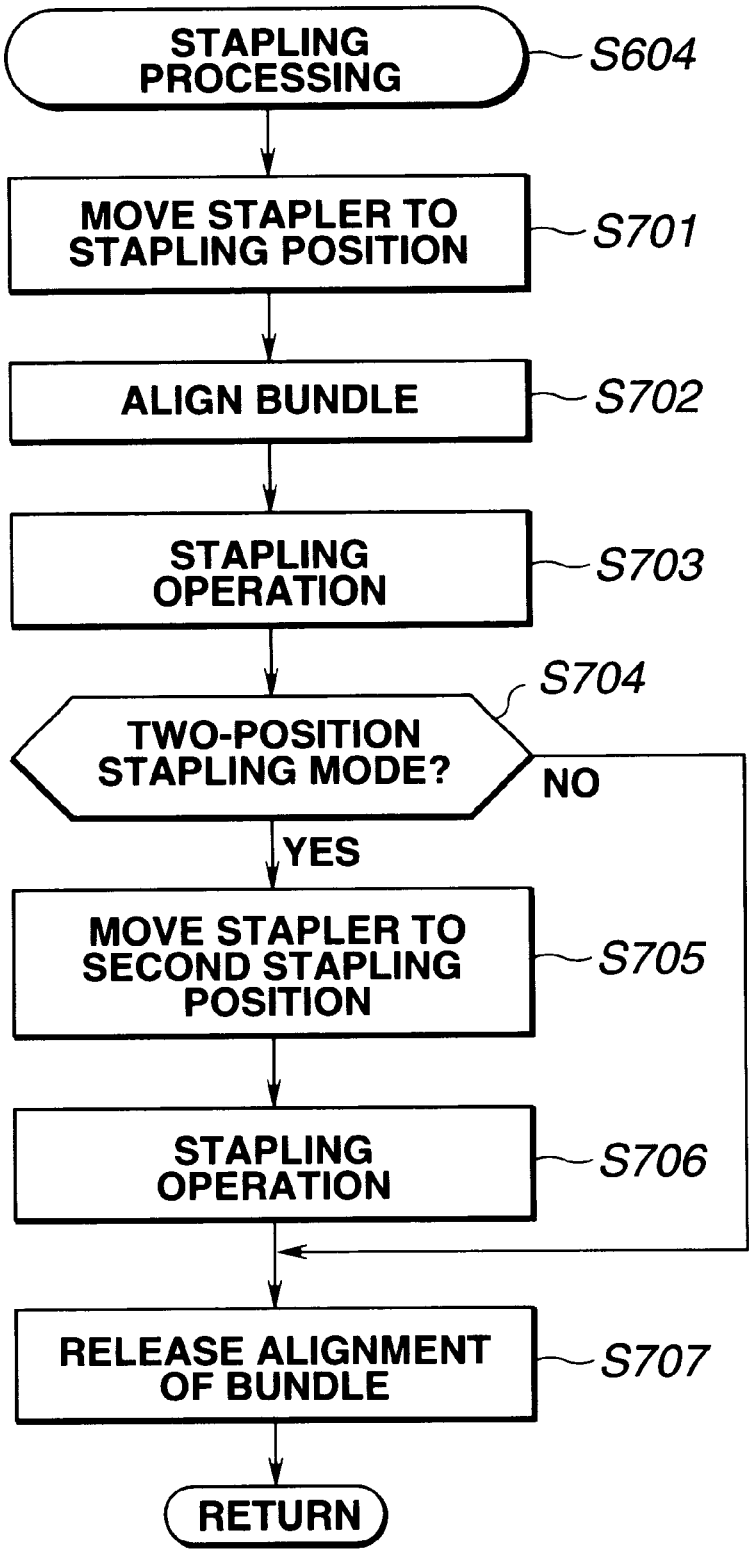
FIG. 14 is a flowchart illustrating stapling processing of the sheet processing apparatus shown in FIG. 1.

Stapling processing will be described with reference to FIG. 14.

When the process enters the stapling processing mode, the stapler 601 is moved by a predetermined amount to a stapling position (step S701), the bundle on the processing tray 630 is aligned using the aligning means 640 comprising the front aligning member and the rear aligning member (step S702), and a stapling operation is performed (step S703).

Then, it is determined if stapling is to be performed in a two-position stapling mode (step S704). If the result of the determination in step S704 is negative, alignment of the bundle by the aligning means comprising the front aligning member and the rear aligning member is released (step S707), and the stapling processing is terminated. If the result of the determination in step S704 is affirmative, the stapler 601 is moved by a predetermined amount to a second stapling position (step S705), a stapling operation on the second position is performed (step S706), alignment of the bundle by the aligning means 640 comprising the front aligning member and the rear aligning member is released (step S707), and the stapling processing is terminated.

Binding Processing

The sheet is conveyed to the saddle conveyance path 524, processing, such as center saddle stitch and the like, is performed, and the bundle of bound sheets is discharged onto and mounted on a saddle discharge tray 702 by saddle discharging rollers 508.

The individual components shown in outline or designated by blocks in the drawings are all well known in the sheet processing apparatus and image forming apparatus arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims.

What is claimed is:

1. A sheet processing apparatus comprising:

sheet conveying means for conveying a sheet and placing the sheet in a waiting state by temporarily stopping conveyance of the sheet, said sheet conveying means operable in one of at least a first mode, a second mode and a third mode;

sheet-conveying-condition detection means for detecting a conveying condition for each sheet;

wherein, in the first mode a sheet is conveyed by driving said sheet conveying means without placing the sheet in a waiting state;

wherein, in the second mode a sheet is conveyed by driving said sheet conveying means and putting said sheet conveying means in the waiting state, thereafter releasing the waiting state of said sheet conveying means in accordance with conveyance of a succeeding sheet, and conveying preceding and succeeding sheets in a superposed state; and wherein, in the third mode a sheet is conveyed by driving said sheet conveying means and putting said sheet conveying means in the waiting state, thereafter releasing the waiting state of said sheet conveying means, and conveying the preceding sheet separately from the succeeding sheet; and control means for switching said sheet conveying means from the second mode to the third mode when said sheet-conveying-condition detection means has detected that a sheet having a different sheet conveying condition is included within a plurality of sheets to be discharged from said sheet conveying means in a superposed state when in said second mode.

2. A sheet processing apparatus according to claim 1, wherein the sheet conveying condition detected by said sheet-conveying-condition detection means is a size of a sheet.

3. A sheet processing apparatus according to claim 1, wherein the sheet conveying condition detected by said sheet-conveying-condition detection means is a speed for conveying a sheet.

4. A sheet processing apparatus according to claim 1, wherein the sheet conveying condition detected by said sheet-conveying-condition detection means is a conveying path for a sheet.

5. A sheet processing apparatus according to claim 1, wherein the sheet conveying condition detected by said sheet-conveying-condition detection means is a portion where a sheet is to be discharged.

6. A sheet processing apparatus according to claim 1, wherein the sheet conveying condition detected by said sheet-conveying-condition detection means is a material of a sheet.

7. A sheet processing apparatus according to claim 1, wherein the sheet conveying condition detected by said sheet-conveying-condition detection means is a bundle formed by sheets.

8. A sheet processing apparatus according to claim 1, wherein the sheet conveying condition detected by said sheet-conveying-condition detection means is a job to be performed by a sheet.

9. A sheet processing apparatus according to claim 1, wherein the sheet conveying condition detected by said sheet-conveying-condition detection means is a mass of a sheet per unit area.

10. A sheet processing apparatus according to claim 1, wherein the sheet conveying condition detected by said sheet-conveying-condition detection means is a mode of binding sheets.

11. A sheet processing apparatus according to claim 1, wherein, when said sheet-conveying-condition detection means has detected that an OHP (overhead projector) sheet is included within a plurality of sheets discharged in a superposed state, the third mode is selected.

12. A sheet processing apparatus according to claim 1, wherein, when said sheet-conveying-condition detection means detects that a sheet fed from an inserter is included within a plurality of sheets discharged in a superposed state, the third mode is selected.

13. A sheet processing apparatus according to claim 1, wherein, when said sheet-conveying-condition detection means detects that a cover is included within a plurality of sheets discharged in a superposed state, the third mode is selected.

14. A sheet processing apparatus according to claim 1, wherein, when said sheet-conveying-condition detection means detects that a synthetic sheet is included within a plurality of sheets discharged in a superposed state, the third mode is selected.

15. A sheet processing apparatus according to claim 1, wherein said sheet conveying means stops the preceding sheet in a conveying path to provide the waiting state, and thereafter reconveys the preceding sheet together with the succeeding sheet in a superposed state after arrival of the succeeding sheet.

16. A sheet processing apparatus according to claim 15, wherein said sheet conveying means comprises a circular buffer path in the conveying path, and guides the preceding sheet temporarily in said buffer path.

17. A sheet processing apparatus according to claim 4, wherein said sheet conveying means comprises a buffer path for stopping a sheet, and wherein said sheet-conveying-condition detection means detects whether or not the sheet stops within said buffer path.

18. A sheet processing apparatus according to claim 1, wherein said sheet conveying means comprises a turn roller for forming a closed-loop path in a conveying path, and wherein, when the sheet conveying condition for the pre-deding sheet coincides with the sheet conveying condition for the succeeding sheet, the preceding sheet is stopped in a state of being wound around said turn roller, thereafter the wound state is released by rotating said turn roller, the preceding sheet is fed together with the succeeding sheet, a fed sheet bundle is mounted onto a tray, and thereafter the sheets are individually discharged onto the sheet bundle on the tray after passing through the conveying path without being wound around said turn roller.

19. A sheet processing apparatus according to claim 1, wherein said control means generates a signal for raising a discharging flag for restarting conveyance of a sheet in a waiting state when the conveying condition for a succeeding sheet differs from the conveying condition for the sheet in the waiting state, and for restarting the sheet in the waiting state when the succeeding sheet reaches a predetermined position if the conveying condition for the succeeding sheet is the same as the conveying condition for the sheet in the waiting state.

20. A method for controlling an image forming apparatus in which a preceding sheet is temporarily stopped in a waiting state in a sheet conveying path and is then conveyed together with a succeeding sheet upon arrival of the succeeding sheet, said method comprising the steps of:

detecting whether or not a sheet conveying condition for the succeeding sheet is the same as a sheet conveying condition for the preceding sheet, and restarting conveyance of the preceding sheet in a waiting state separately from the succeeding sheet when a result of the detection is negative.

21. A method according to claim 20, wherein a bundle of sheets conveyed together is mounted on a discharging tray, and succeeding sheets are individually mounted thereon.

22. A method according to claim 21, wherein the bundle of sheets mounted on the discharging tray is stapled.

23. A method according to claim 22, wherein a sheet of a next job is awaited in the sheet conveying path during the stapling operation.

24. A method according to claim 23, wherein the preceding sheet is put in the waiting state by being guided into and stopped in a buffer path.

25. A method according to claim 20, wherein the preceding sheet separately and independently restarted is discharged onto a discharging tray.

26. A method according to claim 20, wherein the sheet conveying condition is a sheet conveying speed.

27. A method according to claim 26, wherein the restarting of the preceding sheet separate from the succeeding sheet is performed by raising a restarting flag in response to a determination that the sheet conveying speed for the succeeding sheet differs from the sheet conveying speed for the preceding sheet.

28. An image forming apparatus comprising:

image forming means for forming an image on a sheet;

sheet conveying means for conveying a sheet and placing the sheet in a waiting state by temporarily stopping conveyance of the sheet having the image formed thereon, said sheet conveying means operable in one of at least a first mode, a second mode and a third mode;

sheet-conveying-condition detection means for detecting a conveying condition for each sheet;

wherein, in the first mode a sheet is conveyed by driving said sheet conveying means without placing the sheet in a waiting state;

wherein, in the second mode a sheet is conveyed by driving said sheet conveying means and putting said sheet conveying means in the waiting state, thereafter releasing the waiting state of said sheet conveying means in accordance with conveyance of a succeeding sheet, and conveying preceding and succeeding sheets in a superposed state; and wherein, in the third mode a sheet is conveyed by driving said sheet conveying means and putting said sheet conveying means in the waiting state, thereafter releasing the waiting state of said sheet conveying means, and conveying the preceding sheet separately from the succeeding sheet; and control means for switching said sheet conveying means from the second mode to the third mode when said sheet-conveying-condition detection means has detected that a sheet having a different sheet conveying condition is included within a plurality of sheets to be discharged from said sheet conveying means in a superposed state when in said second mode.

29. An image forming apparatus according to claim 28, wherein the sheet conveying condition detected by said sheet-conveying-condition detection means is a size of a sheet.

30. An image forming apparatus according to claim 28, wherein the sheet conveying condition detected by said sheet-conveying-condition detection means is a speed for conveying a sheet.

31. An image forming apparatus according to claim 28, wherein said sheet conveying means stops the preceding sheet in a conveying path to assume the waiting state, and thereafter reconveys the preceding sheet together with the succeeding sheet in a superposed state after arrival of the succeeding sheet.

32. An image forming apparatus according to claim 31, wherein said sheet conveying means comprises a circular buffer path in the conveying path, and guides the preceding sheet temporarily in said buffer path.

33. An image forming apparatus according to claim 28, wherein said sheet conveying means comprises a turn roller for forming a closed-loop path in a conveying path, and wherein, when the sheet conveying condition for the preceding sheet coincides with the sheet conveying condition for the succeeding sheet, the preceding sheet is stopped in a state of being wound around said turn roller, thereafter the wound state is released by rotating said turn roller, the preceding sheet is fed together with the succeeding sheet, a fed sheet bundle is mounted onto a tray, and thereafter the sheets are individually discharged onto the sheet bundle on the tray after passing through the conveying path without being wound around said turn roller.

34. An image forming apparatus according to claim 28, wherein said control means generates a signal for raising a discharging flag for restarting conveyance of a sheet in a waiting state when the conveying condition for a succeeding sheet differs from the conveying condition for the sheet in the waiting state, and for restarting the sheet in the waiting state when the succeeding sheet reaches a predetermined position if the conveying condition for the succeeding sheet is the same as the conveying condition for the sheet in the waiting state.

35. An image forming apparatus comprising:

sheet conveying means for conveying a sheet and placing the sheet in a waiting state by temporarily stopping conveyance of the sheet, said sheet conveying means operable in one of at least a first mode, a second mode and a third mode;

sheet-conveying-condition detection means for detecting a conveying condition for each sheet;

wherein, in the first mode a sheet is conveyed by driving said sheet conveying means without placing the sheet in a waiting state;

wherein, in the second mode a sheet is conveyed by driving said sheet conveying means and putting said sheet conveying means in the waiting state, thereafter releasing the waiting state of said sheet conveying means in accordance with conveyance of a succeeding sheet, and conveying preceding and succeeding sheets in a superposed state; and wherein, in the third mode a sheet is conveyed by driving said sheet conveying means and putting said sheet conveying means in the waiting state, thereafter releasing the waiting state of said sheet conveying means, and conveying the preceding sheet separately from the succeeding sheet; and control means for switching said sheet conveying means from the second mode to the third mode when said sheet-conveying-condition detection means has detected that a sheet having a different sheet conveying condition is included within a plurality of sheets to be discharged from said sheet conveying means in a superposed state when in said second mode;

a main body having therein image forming means for forming an image on a sheet; and discharging means in said main body for discharging the sheet having the image formed thereon by said image forming means to said sheet processing apparatus.

36. An image forming apparatus according to claim 35, wherein the sheet conveying condition detected by said sheet-conveying-condition detection means is a size of a sheet.

37. An image forming apparatus according to claim 35, wherein the sheet conveying condition detected by said sheet-conveying-condition detection means is a speed for conveying a sheet.

38. An image forming apparatus according to claim 35, wherein the sheet conveying condition detected by said sheet-conveying-condition detection means is a conveying path for a sheet.

39. An image forming apparatus according to claim 35, wherein the sheet conveying condition detected by said sheet-conveying-condition detection means is a portion where a sheet is to be discharged.

40. An image forming apparatus according to claim 35, wherein the sheet conveying condition detected by said sheet-conveying-condition detection means is a material of a sheet.

41. An image forming apparatus according to claim 35, wherein the sheet conveying condition detected by said sheet-conveying-condition detection means is a bundle formed by sheets.

42. An image forming apparatus according to claim 35, wherein the sheet conveying condition detected by said sheet-conveying-condition detection means is a job to be performed by a sheet.

43. An image forming apparatus according to claim 35, wherein the sheet conveying condition detected by said sheet-conveying-condition detection means is a mass of a sheet per unit area.

44. An image forming apparatus according to claim 35, wherein the sheet conveying condition detected by said sheet-conveying-condition detection means is a mode of binding sheets.

45. An image forming apparatus according to claim 35, wherein, when said sheet-conveying-condition detection means has detected that an OHP (overhead projector) sheet is included within a plurality of sheets discharged in a superposed state, the third mode is selected.

46. An image forming apparatus according to claim 35, wherein, when said sheet-conveying-condition detection means detects that a sheet fed from an inserter is included within a plurality of sheets discharged in a superposed state, the third mode is selected.

47. An image forming apparatus according to claim 35, wherein, when said sheet-conveying-condition detection means detects that a cover is included within a plurality of sheets discharged in a superposed state, the third mode is selected.

48. An image forming apparatus according to claim 35, wherein, when said sheet-conveying-condition detection means detects that a synthetic sheet is included within a plurality of sheets discharged in a superposed state, the third mode is selected.

* * * * *

UNITED STATES PATENT AND TRADEMARK OFFICE

CERTIFICATE OF CORRECTION

PATENT NO. : 6,219,503 B1
DATED : April 17, 2001
INVENTOR(S) : Norifumi Miyake et al.

It is certified that error appears in the above-identified patent and that said Letters Patent is hereby corrected as shown below:

Title page,
Item [57], ABSTRACT,
Line 3, "temporary" should read -- temporarily --.

Column 1,
Line 36, "retracted" should be deleted.

Column 5,
Line 20, "an" should read -- a --.
Line 62, "201," should read -- 401, --; and "the printer control unit 301, the folding-device control" should be deleted.
Line 63, "unit 401" should be deleted.

Column 6,
Lines 34and 37, "made" should read -- made to be --.
Line 39, "in" should read -- to be in --.

Column 8,
Lines 24 and 57, "has" should read -- have --.

Column 11,
Line 66, "indicates" should read -- indicates the --.

Signed and Sealed this

Twenty-ninth Day of January, 2002

*Attest:*

*Attesting Officer*

JAMES E. ROGAN
*Director of the United States Patent and Trademark Office*